US005504327A

United States Patent [19]

Sproch et al.

[11] Patent Number: 5,504,327

[45] Date of Patent: Apr. 2, 1996

[54] ELECTROSPRAY IONIZATION SOURCE AND METHOD FOR MASS SPECTROMETRIC ANALYSIS

[75] Inventors: Norman Sproch; Terry L. Kruger, both of Muncie, Ind.

[73] Assignee: hvops, Inc. (h-un), Muncie, Ind.

[21] Appl. No.: 147,688

[22] Filed: Nov. 4, 1993

[51] Int. Cl.[6] ..... H01J 49/04

[52] U.S. Cl. ..... 250/288; 250/281; 250/282

[58] Field of Search ..... 250/288, 288 A, 250/281, 282, 289

[56] References Cited

U.S. PATENT DOCUMENTS

| | | | |
|---|---|---|---|
| 3,840,742 | 10/1974 | Ball | 250/288 |
| 4,104,275 | 8/1978 | Kauer | 260/297 |
| 4,209,696 | 6/1980 | Fite | 250/281 |
| 4,271,425 | 6/1981 | Wong | 357/72 |
| 4,367,072 | 1/1983 | Vogtle et al. | 436/501 |
| 4,436,923 | 3/1984 | Pacey et al. | 549/352 |

(List continued on next page.)

OTHER PUBLICATIONS

Papac, D. I., Schey, K. L., Knapp, D. R. "Combination Electrospray–Liquid Secondary Ion Mass Spectrometry Ion Source" *Anal. Chem.* 1991, 63, 1658–1660.

Chowdhury, S. K., Katta, V., Chait, B. T., "An Electrospray–ionization Mass Spectrometer with New Features" 1990.

Odell, B., and Bowyer, J. R. "Solubilisation of Ferricytochrome C in Methanol Using a Crown Ether Absorption, Circular Dichroism and EPR Spectral Properties", *Biochem. Biophys. Res. Commun.* 1985, 127 #3, 828–835.

Odell, B., and Earlam, G., "Dissolution of Proteins in Organic Solvents using Macrocyclic Polyethers: Association Constants of a Cytochrome C–[1,2–$^{14}C_2$]–18–Crown–6 Complex in Methanol", *J. Chem. Soc., Chem. Commun.*, 1985, 359–361.

Chowdhury, S. K., Katta V., Chait, B. T., "Probing Conformational Changes in Proteins by Mass Spectrometry", *J. Am. Chem. Soc.*, 1990, 112, 9012–9013.

Bowler. B. E., May, K., Zaragoza, T., York, P., Dong, A., Caughey, W. S., "Destabilizing Effects of Replacing a Surface Lysine of Cytochrome C with Aromatic Amino Acids: Implications for the Denatured State", *Biochemistry 1993, 32, 183–190.*

Shortle, D., Chan. H. S., Dill, K. A., "Modeling the Effects of Mutations on the Denatured States of Proteins", *Protein Science,* 1992, 1, 201–215.

Mirza, U. A., Cohen S. L., Chait, B. T., "Heat–Induced Conformational Changes in Proteins Studied by Electrospray Ionization Mass Spectrometry", *Anal. Chem.*, 1993, 65, 1–6.

*Primary Examiner*—James Beyer

*Attorney, Agent, or Firm*—Willian Brinks Hofer Gilson & Lione

[57] ABSTRACT

An improved electrospray ionization (ESI) system source and method is presented including an electrospray ionization source for introducing an ionized molecular sample into a mass spectrometer for analysis. The ESI source is constructed in the configuration of a probe that makes use of a standard 0.5 inch (13 mm) vacuum lock commonly found on conventional mass spectrometers. The ESI probe comprises a desolvation tube, a voltage source for applying a voltage to the desolvation tube, a resistance coil for heating the desolvation tube, a sensor for measuring the temperature of the desolvation tube, a skimmer positioned downstream of the desolvation tube for directing the ions to the lens stack of the mass spectrometer, a voltage source for applying a voltage to the skimmer, a spacer lens positioned upstream of the skimmer for focusing the ions prior to their entering the skimmer, and an evacuable dielectric encasement for housing the components of the probe assembly. This novel ESI source makes available a wealth of new analytical methods and applications that heretofore were unknown to the field, including novel data interpretations of ESI results and the ability to determine the process by which protein structures and functions may be modified by the attachment of small molecules to the protein surface, particularly crown ethers.

43 Claims, 19 Drawing Sheets

U.S. PATENT DOCUMENTS

| | | | |
|---|---|---|---|
| 4,531,056 | 7/1985 | Labowsky et al. | 250/288 |
| 4,542,293 | 9/1985 | Fenn et al. | 250/288 |
| 4,838,274 | 6/1989 | Schweighardt et al. | 128/654 |
| 4,842,701 | 6/1989 | Smith et al. | 204/180 |
| 4,885,076 | 12/1989 | Smith et al. | 204/299 |
| 4,935,624 | 6/1990 | Henion et al. | 250/288 |
| 4,977,320 | 12/1990 | Chowdhury et al. | 250/288 |
| 4,999,493 | 3/1991 | Allen et al. | 250/288 |
| 5,015,845 | 5/1991 | Allen et al. | 250/288 |
| 5,068,098 | 11/1991 | Schweighardt et al. | 424/9 |
| 5,071,581 | 12/1991 | Cipriano | 252/77 |
| 5,076,097 | 12/1991 | Zarrinn et al. | 73/61.1 C |
| 5,115,131 | 5/1992 | Jorgenson et al. | 250/288 |
| 5,122,670 | 6/1992 | Mylchreest et al. | 250/423 |
| 5,136,161 | 8/1992 | Logan | 250/293 |
| 5,157,260 | 10/1992 | Mylchreest et al. | 250/423 R |
| 5,170,053 | 12/1992 | Hall et al. | 250/288 |
| 5,171,990 | 12/1992 | Mylchreest et al. | 250/288 |
| 5,196,348 | 3/1993 | Schweighardt et al. | 436/173 |
| 5,223,226 | 6/1993 | Wittmer et al. | 422/100 |
| 5,245,186 | 9/1993 | Chait et al. | 250/288 |

Tuna Heart Cytochrome c with 18-Crown-6 (68:1)

Horse Heart Cytochrome c with Dibenzo-18-Crown-6 (~85:1)

Tuna Heart (1), Horse Heart (2), Yeast (3) Cytochrome c's

Horse Heart Cytochrome c with 18-Crown-6 (1:1)

Horse Heart Cytochrome c with Dibenzo-18-Crown-6 (1:1)

Dicyclohexyl-18-crown-6

18-crown-6

Dibenzo-18-crown-6

Lysine$^+$

Arginine$^+$

Histidine$^+$

18-Crown-6/Lys$^+$

18-Crown-6/Arg$^+$

18-Crown-6/His$^+$

Dibenzo-18-Crown-6/Lys$^+$

Dibenzo-18-Crown-6/Arg$^+$

Dibenzo-18-Crown-6/His$^+$

Experimental vs. Calculated Binding of Crowns to Cytochrome c

ELECTROSPRAY IONIZATION SOURCE AND METHOD FOR MASS SPECTROMETRIC ANALYSIS

FIELD OF INVENTION

The present invention relates to mass spectrometric analysis and, more particularly, to an electrospray ionization (ESI) source for use with standard mass spectrometers.

BACKGROUND OF THE FIELD

The employment of mass spectrometry for identification of chemical structures, molecular weights, determination of mixtures, and quantitative elemental analysis, based on the application of the mass spectrometer, is a known analytical technique. Mass spectrometry may be used to accurately determine the molecular weights and structural information of organic molecules based on the augmentation pattern of molecular fragments and the ions formed when the molecule undergoes ionization. The weights of molecules may be measured by ionizing the molecules and measuring their trajectories in response to electric and magnetic fields in a vacuum.

Organic molecules having a molecular weight greater than about a few hundred to few thousand are of great medical and commercial interest as they include, for example, peptides, proteins, DNA, oligosaccharides, commercially important polymers, organometallic compounds and pharmaceuticals. Large organic molecules, of molecular weight over 10,000 Daltons, may be analyzed in a quadrupole mass spectrometer using "electrospray" ionization to introduce the ions into the spectrometer.

Electrospray mass spectrometry (ESI/MS) has more recently been recognized as a significant tool used in the study of proteins and protein complexes. Electrospray ionization as a method of sample introduction for mass spectrometric analysis is also known. Generally, electrospray ionization is a method whereby ions are formed at atmospheric pressure and then introduced into a mass spectrometer using a special interface. In electrospray ionization, a sample solution containing molecules of interest and a solvent is pumped through a hypodermic needle and into an electrospray chamber. An electrical potential of several kilovolts may be applied to the needle for generating a fine spray of charged droplets. The droplets may be sprayed at atmospheric pressure into a chamber containing a heated gas to vaporize the solvent. Alternatively, the needle may extend into an evacuated chamber, and the sprayed droplets then heated in the evacuated chamber. The fine spray of highly charged droplets releases molecular ions as the droplets vaporize at atmospheric pressure. In either case, ions are focused into a beam, which is accelerated by an electric field gradient, and then analyzed in a mass spectrometer.

Because electrospray ionization occurs directly from solution at atmospheric pressure, the ions formed in this process tend to be strongly solvated. To carry out meaningful mass measurements, it is necessary that any solvent molecules attached to the ions be efficiently removed, that is, the molecules of interest must be "desolvated". In the prior art, desolvation is achieved in one way by interacting the droplets and solvated ions with a strong countercurrent flow (6–9 l/m) of a heated gas before the ions enter into the vacuum of the mass analyzer.

The use of such a strong countercurrent gas flow is expensive and difficult to operate because the gas flow rate and the temperature need to be controlled precisely and be optimized for each analyte and solvent system. If proper gas flow and temperature conditions are not attained, it can result in either an incomplete desolvation of the ions or a decrease in sensitivity as ions may be swept away by the gas at high flow rate. To enhance the desolvation process, some have used collisional activation by applying an electrostatic field in a region of reduced pressure between the sampling orifice of the mass analyzer and the skimmer.

Although high speed pumping is commonly incorporated to allow for the direct sampling of electrosprayed ions into the mass analyzer, the detailed method of ion transport from atmospheric pressure to vacuum is different in each case. Thus ion transport has been achieved through a 0.2 mm bore 60 mm long glass capillary tube and skimmer and a 1.0 mm diameter sampling orifice and skimmer.

Chowdhury et al. disclose in U.S. Pat. No. 4,977,320 a modified mass analyzer connected to an electrospray ion source to form a mass spectrometer. The ion source employed by Chowdhury et al. includes a syringe needle having a high voltage (4–6 KV) imposed upon it and having an exit orifice spaced in ambient atmosphere of the laboratory at a distance (0.5–4.0 cm) from the entrance orifice of a long metal capillary tube. The capillary tube is heated (80°–90° C.) by an electrical resistance coil and held at a lower voltage (under 400 V). The exit orifice of the capillary tube is separated from a skimmer and is disposed within a vacuum chamber having a pressure of about 1–10 torr. A hole (0.5 mm dia.) in the skimmer leads to a second vacuum chamber ($4\times10^{-4}$ torr), to a series of lenses, each with a hole therethrough, and finally to a baffle having a hole (2.4 mm dia.) therethrough leading to the vacuum chamber ($2\times10^{-5}$ Torr) of the mass analyzer (quadrupole analyzer).

In Chowdhury et al., the molecules of interest, a protein, for example, are dissolved in a solvent or mixture of solvents and the solution is then pumped through the syringe needle. The solution is then electrosprayed therefrom in micron size droplets into the atmosphere so it may be viewed and adjusted by the user. The electric field in the gap between the electrospray syringe needle and the entrance orifice of the capillary tube causes the formation of charged droplets that enter the capillary tube. The strong flow of gas in the capillary tube as a result of the pressure differential between the ends of the tube causes the charged droplets to progress down the center of the tube. Heating of the capillary tube causes evaporation of the droplets and desolvation of the resulting molecule ions of interest. (Chowdhury et al. state that the capillary tube may be heated by an electrical resistance wire wound about the tube or the tube may be a resistive heating element.) The ions then exit into a vacuum chamber where solvent is further removed by collisional activation and then the charged ions pass through the hole in the skimmer, through the holes in the lenses and baffle and ultimately into the spectrometer.

In U.S. Pat. No. 5,015,845, Allen et al. disclose an electrospray method for mass spectrometry wherein a high voltage is applied to a capillary tube for receiving spray droplets containing sample solute of interest and solvent at substantially atmospheric pressure or above. The electrosprayed droplets are passed into an ion generating chamber which is maintained at a pressure in the range of about 0.1 to 10 torr. The walls of the ion generating chamber are controllably heated to a temperature that desolvates the droplets and produces ionized molecules of interest for analysis by the mass spectrometer.

Chowdhury et al. state that it is an object of their invention to provide an ion source that will fit on commercial mass analyzers with only minor modifications; however, a need exists for an effective electrospray ionization source compatible with commercial mass analyzers having standard 0.5 inch (13 mm) vacuum locks thereby requiring no modifications.

SUMMARY OF THE INVENTION

This invention provides an improved electrospray ionization (ESI) system, source and method including a simple, economical, and efficient electrospray ionization source constructed in the configuration of a probe that makes use of a standard 0.5 inch (13 mm) vacuum lock commonly found on conventional mass spectrometers. This novel ESI source opens the door to a wealth of new methods and applications that heretofore were unknown to the field. The ESI source of this invention also provides a foundation for novel data interpretations of ESI results to unlock the secrets to the structures of molecules and molecular complexes, particularly proteins. A significant breakthrough provided by this invention is the ability to now determine the process by which the three-dimensional structure of proteins may be modified by the attachment thereto of small molecules, particularly crown ethers. With the attachment of crown ethers, the surface hydrophobicity of a protein molecule is increased thereby causing a change in its molecular structure which is observable in the mass spectra protein characterization provided by this invention. This phenomenon was not heretofore observable until the development of the ESI probe of this invention.

As discussed in more detail below, the mode by which the protein surface is modified has been initially confirmed by experimentation showing that the crown ethers bind primarily to three amino acids located on the protein surface. This is a valuable discovery in that virtually all drugs work by changing the structure of proteins, and thereby their function, in some manner at the molecular level.

The principal components of the probe assembly have been placed inside a tubular encasement of dielectric material, making use of the electrical insulating properties of the dielectric tube while allowing for visual adjustments of internal components to be readily made. The ESI source utilizes a controllably heated, electrically conductive capillary for desolvation. No modifications to the standard electron ionization/chemical ionization lens assembly of the mass spectrometer are required to obtain excellent results. The spectra acquired by this invention (*J Am Soc Mass Spectrom* 1993, accepted) are in excellent agreement with those previously published.

More particularly, this invention provides an electrospray ionization probe assembly for introducing a sample of ions into a mass spectrometer for mass spectrometric analysis comprising desolvation means having an entrance orifice and an exit orifice, means for applying a voltage to the desolvation means, means for controllably heating the desolvation means, means for measuring the temperature of the desolvation means, skimmer means for focusing and directing the ions to the mass spectrometer, lens means positioned before the skimmer means for initially focusing the ions prior to their entering the skimmer means, and an evacuable dielectric encasement for housing the components of the probe assembly.

The sample of ions is initially generated by electrospray means generating a spray of charged droplets containing the molecules, or molecular complexes, of interest and solvent. The skimmer means is provided with an axial orifice extending therethrough electrically isolated from the desolvation means and positioned at a distance from the exit orifice of the desolvation means. The lens means comprises spacer means threadably affixed to the desolvation means adjacent the exit orifice thereof by an adjustable engagement for transporting and focusing the ions of interest.

This invention also defines a system for analyzing the mass spectra of molecules and molecular complexes of interest comprising a mass spectrometer having an inlet orifice for receiving therein ionized molecules of interest and molecular complexes, and an electrospray ion source coupled to the mass spectrometer for introducing ionized molecules of interest and molecular complexes therein for analysis. The electrospray ion source of this system includes a source of a dilute solution of the molecules of interest, electrospray means for generating a fine spray of tiny charged droplets of said solution, means for imposing a first voltage on the electrospray means, a capillary tube having an entrance orifice positioned across a gap from the electrospray means for receiving the charged droplets and an exit orifice for the ionized molecules of interest, means for imposing a second voltage on the capillary tube, means for controllably heating the capillary tube, a sampling cone for directing the ionized molecules of interest to the mass spectrometer, lens means positioned before the sampling cone for initially focusing the ionized molecules prior to their entering the sampling cone, an evacuable tubular dielectric encasing for housing the capillary tube, heating means, thermocouple means, sampling cone, and lens means, and means for creating a vacuum in the mass spectrometer and evacuable encasing. The mass spectrometer has a vacuum chamber forming the inlet orifice that forms a vacuum seal with the evacuable encasement adjacent the outlet side of the sampling cone. The source of a dilute solution of molecules of interest includes a syringe needle tube through which the solution is pumped to the electrospray means. The syringe needle is positioned a short distance from an entrance orifice of the capillary tube.

This invention also generally defines a method for introducing desolvated ionized molecules of interest into a mass spectrometer for analysis generally comprising the steps of creating a dilute solution of molecules of interest in a solvent, generating a fine spray of tiny droplets of the dilute solution of molecules and solvent, charging the tiny droplets, providing a desolvation tube having an entrance orifice and an exit orifice, positioning the entrance orifice of the desolvation tube adjacent the point of generation of the fine spray of tiny charged droplets, applying a voltage to the desolvation tube, receiving the charged droplets in the entrance orifice of the desolvation tube, transporting the droplets to the exit orifice of the desolvation tube, controllably heating the desolvation tube to substantially desolvate the droplets during their transport therethrough to provide ionized molecules of interest at the exit orifice of the desolvation tube, focusing the ionized molecules after their exiting the desolvation tube, and directing the focused ionized molecules of interest upon their exit from the focusing means through a skimmer means to remove inadequately ionized molecules of interest.

Further provided by this invention is a method for characterizing the three-dimensional structure of a protein molecule comprising creating a dilute solution of protein molecules and molecular complexes of interest in a solvent, adding a predetermined amount of crown ethers to the solution so that the smaller crown ether molecules bind to the large protein molecules, generating a fine spray of tiny droplets of the solution of protein molecule-crown ether complexes and solvent, charging the tiny droplets, providing a desolvation tube having an entrance orifice and an exit orifice, positioning the entrance orifice of the desolvation tube adjacent the point of generation of the fine spray of tiny droplets, applying a voltage to the desolvation tube, receiving the charged droplets in the entrance orifice of the desolvation tube, transporting the droplets to the exit orifice of the desolvation tube, controllably heating the desolvation tube to substantially desolvate the droplets during their transport therethrough to provide ionized protein molecules at the exit orifice of the desolvation tube, focusing the ionized protein molecule-crown ether complexes after exiting the desolvation tube, and directing the focused ionized protein molecule-crown ether complexes upon their exit from the focusing means through a skimmer means to remove inadequately ionized protein molecule-crown ether complexes.

Other features and advantages of the invention will be apparent from the drawings and a more detailed description that follows.

BRIEF DESCRIPTION OF THE DRAWINGS

FIGS. 14A, 14B–16 are electrospray ionization mass spectra of horse heart cytochrome c binded with three different crown ethers;

DESCRIPTION OF THE PREFERRED EMBODIMENTS

This invention comprises an electrospray ionization (ESI) system, an ESI probe source and method for introducing ionized molecules of interest directly into an unmodified electron ionization/chemical ionization (IE/CI) lens assembly of a mass analyzer. The ESI source of this invention has been designed as a removable probe and is therefore conveniently referred to hereafter as an ESI "probe".

Figure 1:
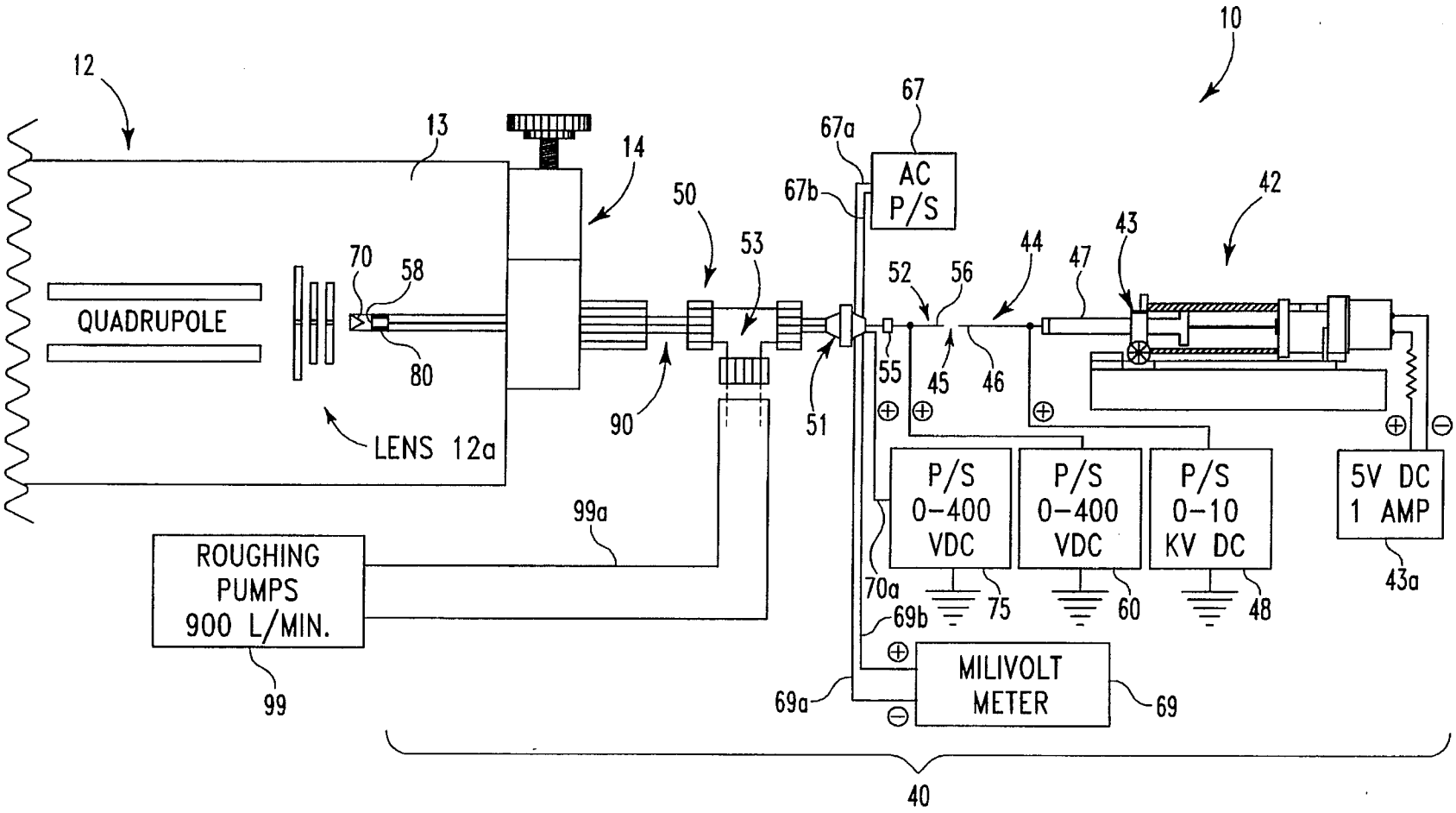
FIG. 1 is a schematic diagram of the mass spectrometric analysis system of this invention.

FIG. 1 shows a system 10 for analyzing the mass spectra of molecules and molecular complexes of interest, comprising a mass analyzer 12 having an inlet orifice means 14 for receiving therein ionized molecules of interest and molecular complexes to be analyzed and an electrospray ion source 40 connected to analyzer 12 for introducing ionized molecules of interest and molecular complexes therein for analysis. For convenience, when reference is made below to "molecules of interest" it is to be understood to include molecules and molecular complexes, such as protein and crown ether complexes. The mass spectrometer shown in FIG. 1 is a schematic representative instrument and the discussion herein applies to mass spectrometers in a general sense. Inasmuch as such mass spectrometers are well known, complete details of its structure and operation need not be given.

Electrospray ion source 40 can include a source 42 for providing a dilute solution of the molecules of interest, electrospray means 44 for generating a fine spray of tiny charged droplets of the solution, a high voltage means 48 for imposing a first voltage on electrospray means 44, desolvation means 52 having an entrance orifice 56 positioned across a gap 45 from electrospray means 44 for receiving the charged droplets of solution and an exit orifice 58, a second voltage means 60 for imposing a voltage on desolvation means 52, means 66 and 68 for controllably heating desolvation means 52, sampling or skimmer means 70 for directing the ionized molecules of interest to the mass spectrometer 12, lens means 80 positioned upstream of skimmer means 70 for initially focusing the ionized molecules of interest after their exiting desolvation means 52 and prior to their entering skimmer means 70, an evacuable dielectric encasing 90 for housing desolvation means 52, heating means 66 and 68, skimmer means 70 and lens means 80, and vacuum pump means 99 for creating a vacuum in encasing 90.

Mass analyzer 12 has a vacuum chamber 13 forming inlet orifice means 14, which forms a vacuum seal with evacuable encasing 90 adjacent the outlet side of skimmer means 70. Inlet orifice means 14 is of the conventional 0.50 inch (13 mm) vacuum lock type commonly found on conventional mass spectrometers so details of its structure need not be given. Mass analyzer 12 can be defined by a single, double, triple or more quadrupole mass spectrometer having an internal pressure of about $10^{-5}$ to $10^{-6}$ torr in its analyzer section. The source 42 of the dilute solution can be provided by a syringe pump 43 coupled to a DC power source **43*a* to pump the solution through a needle 46 to generate a fine spray of tiny droplets of the dilute solution in the gap area 45 adjacent the entrance orifice 56 of a capillary tube 54 which defines desolvation means 52. The end or exit orifice of syringe needle 46 is preferably positioned about 0.5 to about 5.0 cm from entrance orifice 56. As an alternative to syringe pump 43, the dilute solution may be provided by a continuous infusion (e.g., high pressure liquid chromatography pumps). Voltage means 48 applies a high voltage to needle 46 in the range of about 800 VDC to about 8000 VDC, preferably about 4000 VDC. Pump means 99 can include a conduit 99***a* connected to a mechanical vacuum pump 99 with a capacity of 900 L/min to create a vacuum in the evacuable encasing 90 in the range of about 10 torr to about $10^{-3}$ torr, preferably about 1 torr.

Figure 2:
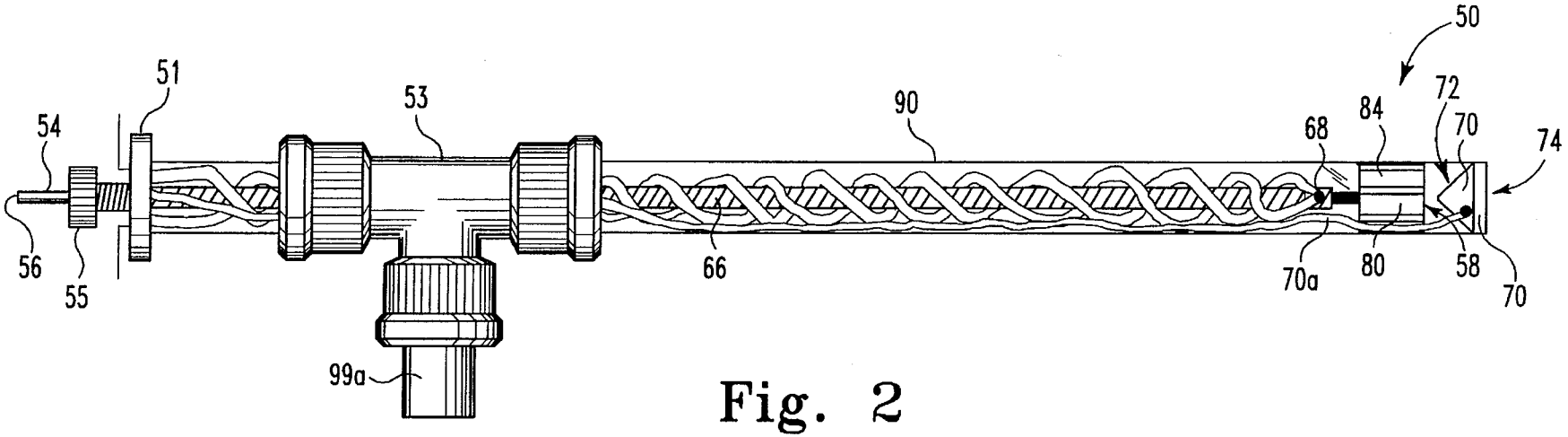
FIG. 2 is a side plan view of the electrospray ionization probe assembly provided by this invention.

Referring now to FIG. 2, an isolated view of the ESI probe 50 is shown in more detail wherein desolvation means 52 is defined by a capillary tube 54 having an upstream entrance orifice 56 and a downstream exit orifice 58. A voltage of about 2 to 1000 V is applied to tube 54 externally of dielectric encasement 90 by second voltage means 60 (FIG. 1). Capillary tube 54 preferably has an inner diameter of about 0.020 inch (0.5 mm), an outer diameter of about 0.0625 inch, and an overall length no greater than 500 mm, preferably about 430 mm. Probe 50 has an overall length of about 44 cm.

The means for controllably heating capillary tube 54 can include an electrical resistance coil 66 wound about capillary tube 54 and a temperature sensor 68 operably connected to a readout means, definable by a voltmeter 69, via connectors 69*a* and 69*b* (FIG. 1) for correlating the voltage applied to the coil 66 with temperature. Electrical resistance coil 66 can include a pair of nichrome wires 67*a* and 67*b* coupled to an AC power source 67. In operation, coil 66 heats capillary tube 54 in the temperature range of about 25° C. to about 200° C.

Figure 4:
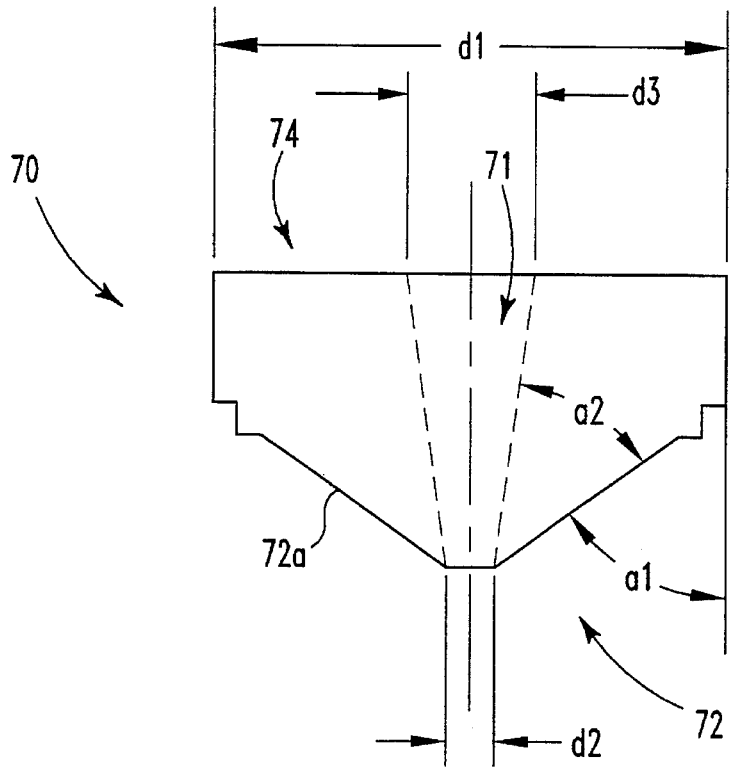
FIG. 4 is a cross section of the sampling cone or skimmer employed by the alternative embodiments of this invention as shown in FIGS. 2 and 3, respectively.
Figure 5:
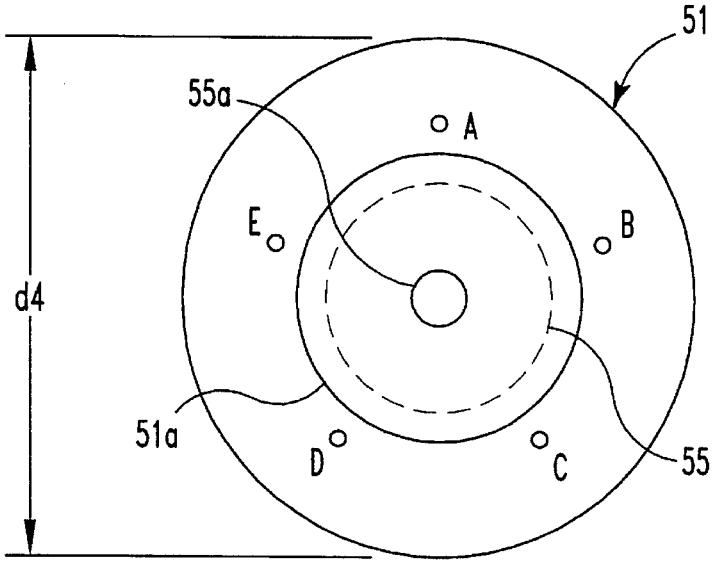
FIG. 5 is an end view taken from the left end of FIG. 2.

As shown in FIGS. 2 and 4, sampling cone 70 has an inlet side 72, an outlet side 74 and a central orifice 71 extending therethrough, with the inlet side 72 positioned at a first distance of about 1–10 mm. from the exit orifice 58 of capillary tube 54. Sampling cone 70 is preferably electrically isolated from tube 54 and has a separate voltage applied thereto by third voltage means 75 (FIG. 1) via connector 70a. Central orifice 71 has a frusto-conical shape with a diameter $d_2$ at inlet side 72 of about 0.020 inch and a diameter $d_3$ at outlet side 74 of about 0.275 inch. Cone 70 has an outer diameter $d_1$ of about 0.50 inch (13 mm). Conical inlet side 72 is disposed at an angle $a_1$ of about 40° and the angle $a_2$ between the wall 72*a* of inlet side 72 and the interior wall of central orifice 71 is about 30°.

ESI probe 50 can further include a vacuum endcap 51 disposed in evacuable encasement 90 adjacent entrance orifice 56 of capillary tube 54 and a fingertight fitting 55 for selectively positioning the entrance orifice 56 of tube 54 relative to the discharge opening of syringe needle 46. Endcap 51 can be provided with a plurality of holes for feeding electrical connectors through to the interior of housing 90. In a preferred embodiment, endcap 51 has an outer diameter $d_4$ of about 0.75 inch and is provided with five wire feedthrough holes A–E, where two of the holes carry wires 67*a* and 67*b* to form heating coil 66 coupled to power source 67, two more of the holes carry wires 69*a* and 69*b* coupling the temperature sensor 68 to voltmeter 69, and the remaining hole carries wire 70*a* coupling sampling cone 70 with voltage means 75.

Fitting 55 further allows for the selective positioning of the exit orifice 58 of tube 54 relative to the inlet side 72 of sampling cone 70. Fitting 55, provided with a central bore 55*a*, acts as a clamping device when press-fitted in central opening 51a of endcap 51 to maintain the vacuum within encasing 90 while fixing in location capillary tube 54 relative to endcap 51. To selectively position tube 54, fitting 55 may be loosened and tube 54 pushed or pulled slightly to alter the gap 45 or the distance between exit orifice 58 and skimmer inlet side 72. Additionally, tube 54 may be selectively threaded into spacer lens 80 to achieve similar results. During the operation of probe 50, fitting 55 cannot be loosened, of course, so either the syringe pump 43 may be moved closer to or farther from capillary entrance orifice 56 to alter gap 45, and/or the probe 50 itself may be moved to alter the gap 45 and/or the distance between the skimmer outlet side 74 and the lens stack 12*a* of spectrometer 12.

Evacuable dielectric housing 90 is constructed preferably of glass having an inner diameter of about 0.390 inch and outer diameter of about 0.510 inch. While glass is preferable, other dielectric materials may prove suitable for housing 90.

Lens means 80 can include a brass metal spacer adapted to be positioned upstream of the inlet side 72 of sampling cone 70 for initially focusing the ions of interest after their exit from the exit orifice 58 of capillary tube 54 and prior to their entering the orifice 71 of sampling cone 70. In a preferred embodiment, spacer lens 80 is not insulated from but is threadably affixed to capillary tube 54 adjacent its exit orifice 58 so that the inner (downstream) face of spacer lens 80 can be generally flush with orifice 58. Being threadable, spacer lens 80 is adjustable to selectively position the downstream side of spacer lens 80 in relation to the inlet side 72 of sampling cone 70.

Figure 3:
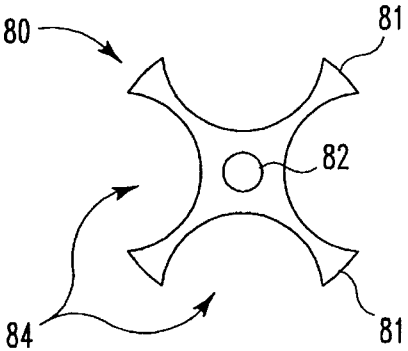
FIG. 3 is a top plan view of a lens focusing means of the electrospray ionization probe assembly provided by this invention.

As shown in FIG. 3, spacer lens 80 is provided with a central threaded orifice 82 and a plurality of longitudinal voids 84 extending therethrough all about its circumference. Voids 84 allow for the solvent molecules and any impurities, and molecules having improper kinetic energy, to be drawn therethrough and removed from within housing 90. Spacer lens 80 can be electrically isolated from the capillary tube 54 but, as indicated above, it need not be. In the event spacer lens 80 is electrically isolated from tube 54, probe assembly 50 can further include means for applying a separate voltage to spacer lens 80. Spacer lens 80 also acts to support capillary tube 54 concentrically within the encasement 90 by its peripheral surfaces 81 engaging the interior wall of encasing 90 to secure and maintain the coaxial alignment of the exit orifice 58 of tube 54 with the central orifice 71 of sample cone 70 and the lens stack 12*a* of mass spectrometer 12.

This invention further provides a method for introducing desolvated ionized molecules and molecular complexes of interest into a mass spectrometer 12 for analysis, including the steps creating a dilute solution of molecules of interest in a solvent, generating a fine spray of tiny droplets of the dilute solution of molecules of interest and solvent with an electrospray means 46, charging the tiny droplets with a high voltage means 48, providing a desolvation tube 54 having an entrance orifice 56 and an exit orifice 58, positioning the entrance orifice 56 of desolvation tube 54 adjacent the point of generation of the fine spray of tiny droplets at syringe needle 46, applying a voltage to desolvation tube 54 by a voltage means 60, receiving the charged droplets in the entrance orifice 56 of desolvation tube 54, transporting the droplets to the exit orifice 58 of desolvation tube 54, controllably heating desolvation tube 54 employing a heater coil 66 coupled to a temperature sensor 68 to substantially desolvate the droplets during their transport through tube 54 to provide ionized molecules of interest at the exit orifice 58 of tube 54, focusing the ionized molecules of interest after their exiting of the desolvation tube 54, and directing the focused ionized molecules of interest upon their exit from the focusing means 80 through a sampling cone 70 having a voltage applied thereto, whereby the voltage differential between desolvation tube 54 and the sampling cone 70 acts to select ions with proper kinetic energy and electrostatically focuses the ions to be transported to the mass analyzer 12.

Sampling cone 70, because of its voltage differential with desolvation or capillary tube 54, serves as a type of filter allowing only ions of the proper kinetic energy through its central orifice 71 to the mass analyzer 12. Ions with higher kinetic energy generally have a greater tendency to move in a substantially linear fashion and, therefore, a greater tendency to travel through the central orifice 71 of cone 70. Those ions with insufficient kinetic energy are deflected by conical wall 72*a* of the inlet side 72 of cone 70 and eventually withdrawn back upstream through longitudinal voids 84 provided in spacer lens 80.

A further method is provided by this invention for observing non-covalent complexes between small molecules and typically larger protein molecules. Such phenomena had not been observable until applicants' experiments with the probe assembly of this invention. More particularly, this technique may be used to study the binding of crown ethers to different types of cytochrome c protein complexes. Previous work by others has suggested the binding of certain crowns to the surface of proteins, such as cytochrome c where the suggested binding side is the solvent-exposed protonated lysine residue. The results of applicants' study is reported in more detail in Example Two below.

Such a method for characterizing the three dimensional structure of a protein complex comprises creating a solution of different interacting molecules comprising small molecules and larger protein molecules, adding a predetermined amount of crown ethers to the solution so that the smaller crown ether molecules bind to the larger protein molecules, generating a fine spray of tiny droplets of the solution and charging the tiny droplets with an electrospray means 46 and a first voltage means 48 positioning the entrance orifice 56 of a desolvation or capillary tube 54 adjacent the point of generation of the fine spray of tiny droplets adjacent a syringe needle 46, applying a second voltage to capillary tube 54 with a second voltage means 60, drawing and receiving the charged droplets in the entrance orifice 56 of tube 54, transporting the droplets to the exit orifice 58 of desolvation tube 54, controllably heating desolvation tube 54 to substantially desolvate the droplets during their transport through tube 54 to provide ionized protein molecule complexes at the exit orifice 58 of tube 54, focusing the ionized protein molecule complexes after their exiting the desolvation tube 54 with a focusing lens means 80 positioned upstream of a sampling cone 70 and directing the focused ionized protein molecule complexes upon their exit from the focusing means 80 through sampling cone 70 to remove inadequately ionized molecule complexes and on through to mass analyzer 12.

In the setup of system 10 provided by this invention utilized in the experiments discussed below, the syringe pump 43 emitting the fine spray aerosol is positioned collinearly with and about 0.5 cm away from the capillary tube 54. The right portion of the probe 50 (30–35 cm) is inserted through the front gate valve (inlet orifice means 14) of the mass spectrometer 12, which in other experiments is used to insert an ion volume. The aerosol originates from the blunt needle 46 (Hamilton 80426, 25 gauge, #3 point) fitted to a Hamilton #701 (Reno, Nev.) 10 μL syringe 47 using a flow rate of 2 μL/min of $3–7\times10^{-5}$M solution. Syringe needle 46 was maintained at a potential of about 4000 VDC by first voltage means 48. Capillary tube 54 was a stainless steel tube (Upchurch Scientific, Oak Harbor, Wash.) maintained at a potential of about 170 VDC by second voltage means 60. As noted above, tube 54 need not be constructed of metal and may be made from other suitable electrically conductive materials. One end (exit end 58) of the capillary tube 54 is threaded into the spacer lens 80 until the inner (downstream) face of the spacer is flush with orifice 58. The inner surface of the spacer lens 80 is positioned about 3 mm from the inlet side 72 of skimmer cone 70. The ESI probe 50 is evacuated through the 13-mm encasement 90 by means of a stainless steel Cajon Ultra-Torr Tee 53 (½, SS-8-UT-3, Cajon Company, Macedonia, Ohio) and connecting pump conduit 99*a* leading to pump 99. A pumping capacity of 834 L/min (2 Edwards 18's @417 L/min each) has been found by the applicants to be adequate for efficient operation.

External electrical connections at the probe 50 provided for application of about 170 VDC on the capillary tube 54, about 58 VDC on the skimmer cone 70, and the heating of the capillary tube 54 to about 95° C. using an alternating current power source 67 (Variac, typically 10 VAC). The high voltage, capillary, and skimmer voltages are referenced to and use a common ground and are isolated from the grounded instrument to reduce interference from occasional high voltage arcing.

The heating coil 66 is preferably made from 0.5-mm diameter nichrome wire (Omega Engineering, Stamford, Conn., N180-020-50, AWG 24) wound around the capillary tube 54 insulated, as are all internal probe wires, with fiberglass sleeving (Omega Engineering, FBGS-N-24). An iron-constantan thermocouple 68 (Scientific Instrument Services, Ringoes, N.J., TH-4) can be used for temperature measurement operably connected with a Keithley 150B microvolt meter 69 via connectors 69*a* and 69*b*. The high voltage was provided by an Antek (Palo Alto, Calif.) PS-4 series power supply (first voltage means 48) used by Extrel for the FAB accessory. Two identical Heathkit (Benton Harbor, Mich.) IP-17 regulated power supplies can provide the two other DC voltages (second and third voltage means 60 and 75). The power supply voltages can be monitored with Simpson 260 (analog) and 460 (digital) multimeters.

The probe endcap 51 with wire feedthrough holes A–E can be sealed to the housing 90 by using Apiezon W (Apiezon Products, Ltd, England) vacuum wax. Skimmer cone 70 can be sealed to the housing 90 by using DEVCON 5-Minute epoxy (DEVCON CORP., Danvers, Mass.). The endcap 51 was constructed of stainless steel and machined to desired dimensions. Fingertight fitting 55 was provided by a stainless-steel Knurl-Lok I fitting with a PEEK ferrule (Alltech Associates, Inc., Deerfield, Ill.) for carrying the capillary tube 54 machined to desired dimensions and pressed into the endcap 51 to support tube 54 coaxially within a central bore 51*a* formed in endcap 51.

The pressure in the line 99*a* leading from the mechanical pumps 99 to the probe tee 53, which can be measured using a Hastings gauge, is preferably about 1 torr. The pressure in the source and analyzer manifolds can be monitored by using ion gauge tubes giving typical values, respectively, of about $1.5\times10^{-4}$ and $1.5\times10^{-5}$ torr. The capillary-to-skimmer gap may be adjusted to maintain pressure in the analyzer section of the mass spectrometer at about $10^{-5}$ torr.

EXAMPLE ONE

At least three kinds of quadrupole mass spectrometers can be used with this invention to characterize the ionization source. Two single quadrupole instruments and one custom double quadrupole instrument have been used in applicant's laboratory testing and found to be suitable. Two different data systems have also been used for data acquisitions. Applicant has found suitable Extrel's Ionstation software (Ver. 2.0) on a Sun Sparcstation II with the Extrel 400, and a Teknivent (Maryland Heights, Mo.) Vector Two on a custom Extrel single and 90 degree Extrel 400 dual quadrupole.

Figure 6:
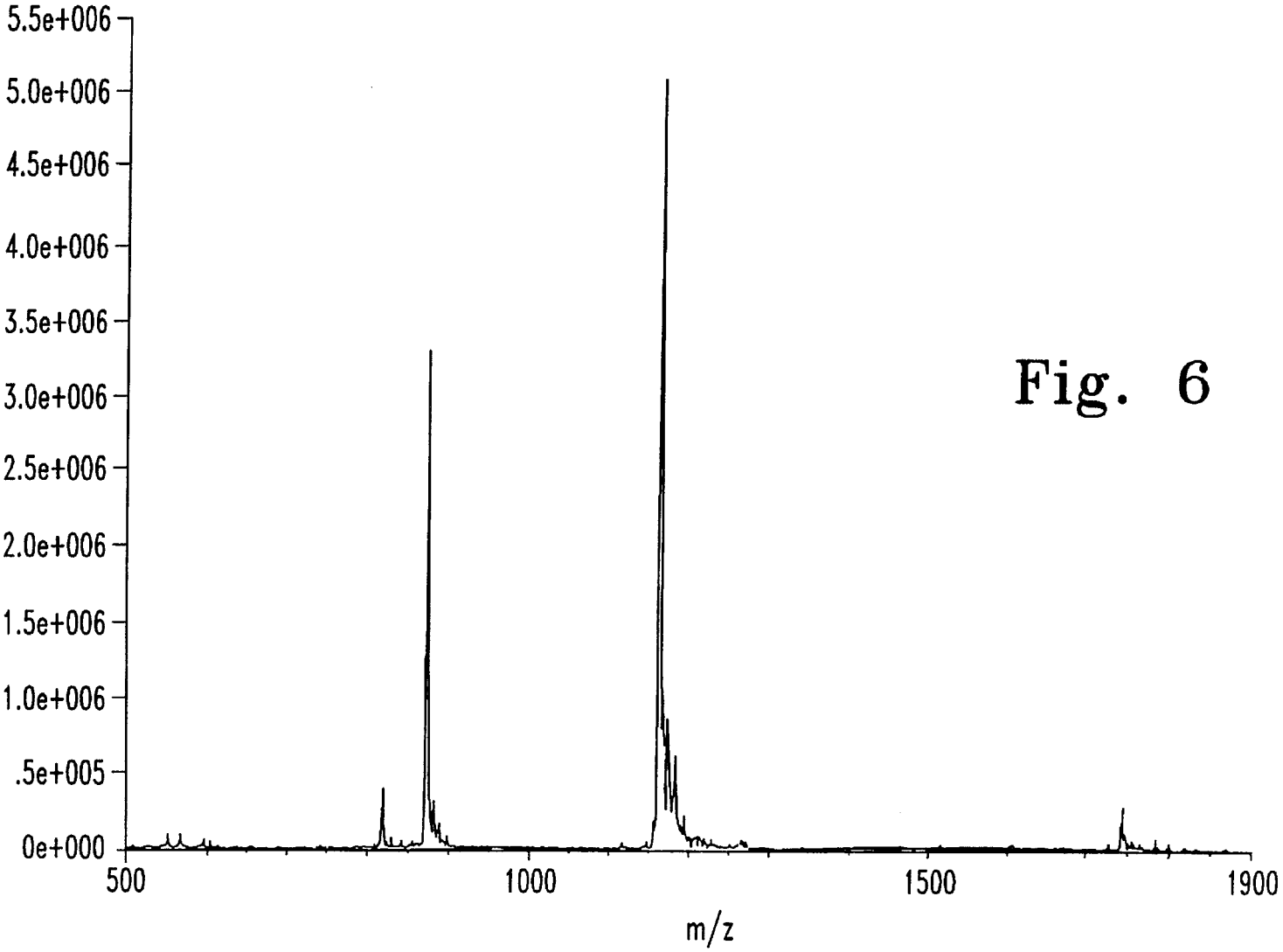
FIG. 6 is an electrospray ionization mass spectrum of glucagon.

In this experiment, the following polypeptides were used to optimize the ESI source of this invention: angiotensin III (Sigma #A-0903, 30 pmol/μL), bradykinin (Sigma #B-3259, 47 pmol/μL), renin substrate (Sigma #R-8380, 56 pmol/μL), melittin (Sigma #M-2272, 50 pmol/μL), and glucagon (FIG. 6, Sigma #G-1774, 50 pmol/μL). These polypeptides were prepared with equal parts of methanol and 1% acetic acid/water. Cytochrome c (FIG. 7, horse heart, Sigma #C-2506, 67 pmol/μL) was prepared with 2% acetic acid/water and methanol.

Figure 7:
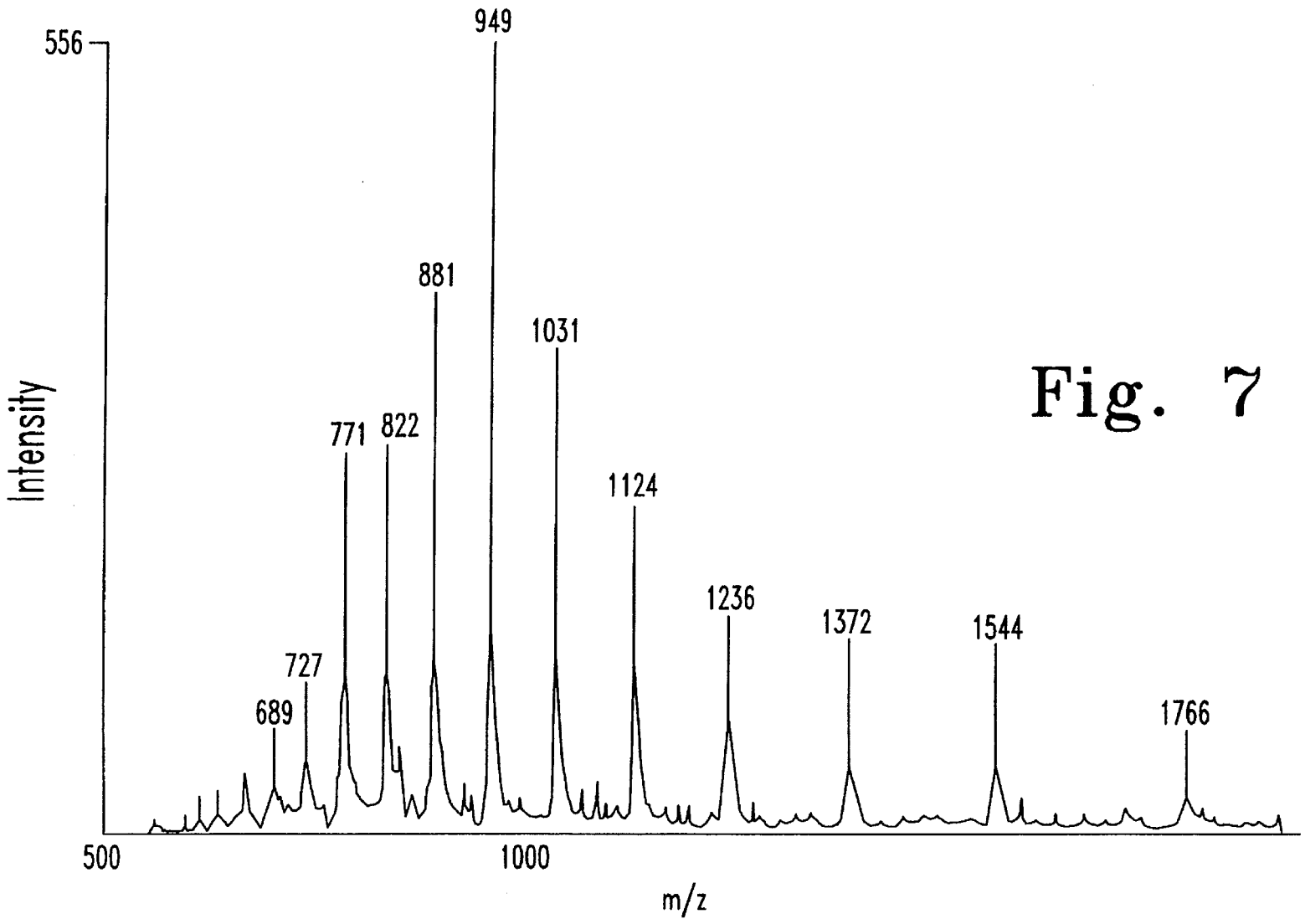
FIG. 7 is an electrospray ionization mass spectrum of cytochrome c (horse heart)

The ESI spectrum of glucagon depicted in FIG. 6 was characterized using a standard EI/CI lens assembly on an Extrel dual quadrupole mass spectrometer (50 pmol/μL in 50:50 MeOH:$H_2O$, 1% acetic acid infused at 2 μL/min). The spectrum was acquired with a Teknivent (Maryland Heights, Mo.) Vector Two data system scanning at 72 u/s, between a mass range of 500 to 1900 u over a 6.60 minute period with the electron multiplier set at −1800 VDC. In FIG. 7, the ESI spectrum of cytochrome c (horse heart) was characterized using an Extrel ELQ 400 single quadrupole mass spectrometer (67 pmol/μL in 50:50 MeOH:$H_2O$, 2% acetic acid infused at a 2 μL/min). The spectrum was acquired with an Extrel/Sun Ionstation data system scanning at 333 u/s between a mass range of 450 to 2000 u over a 1.88 minute period with an electron multiplier set at −1800 VDC.

The data collected on the three different instruments gave similar results which were quite comparable with previously published results. While no attempt was made to maximize the sensitivity of the system, as little as 8 seconds of accumulated scans, at 400 u/s covering a mass range of 1550 u, was found to produce a characteristic spectrum. In the spectra of glucagon and cytochrome c shown in FIGS. 6 and 7, respectively, the relative intensity differences within the envelope of peaks as compared to other published data may be attributed to different concentrations of acid or to slight differences in operating conditions. The change in acid concentration causes a shift of the multiply protonated molecular ion envelope, increased acid concentration showing more highly protonated species. Glucagon (FIG. 6, 3483 Da) was characterized by two predominant peaks, the +4 (m/z 872) and the +3 (m/z 1162) multiply protonated molecular ions. This is representative of other reported spectra (the small peaks were not identified). Cytochrome c (12,360 Da was characterized (FIG. 7) by an envelope of ions representing a range of charge states from 7 to 20 with the most intense peak at +13 (m/z 949). The spectrum compares favorably with the envelope of peaks previously reported. Comparisons were obtained on both single and dual quadrupole instruments, with few differences seen in spectra or total ion count.

EXAMPLE TWO

Figure 17A:
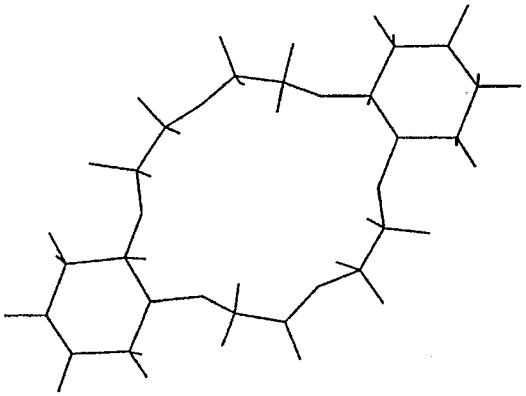
FIGS. 17A–17C present the molecular structure of three crown ethers, dicyclohexano-18-crown-6, 18-crown- 6, and dibenzo-18-crown-6.
Figure 17B:
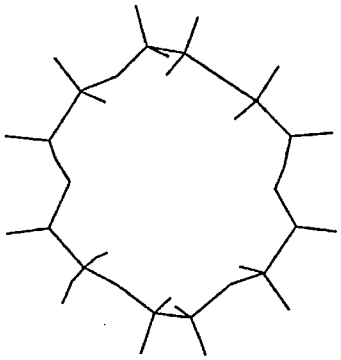
Figure 17C:
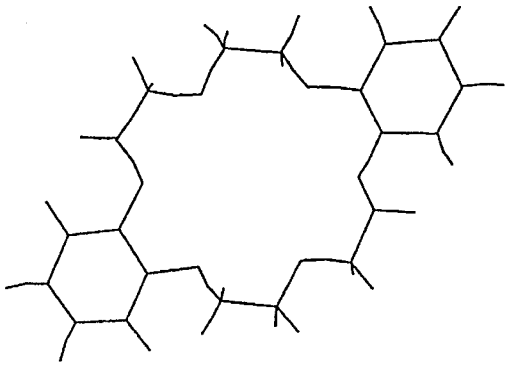

A study was conducted of the non-covalent interactions of three crown ethers, dicyclohexano-18-crown- 6 (#1), 18-crown-6 (#2), and dibenzo-18-crown-6 (#3) (FIGS. 17A–17C) with three types of cytochrome c; horse, tuna and yeast, utilizing the ESI probe 50 and method of this invention. Each of the three different types of cytochrome c displayed different degrees of binding for each of the three crown ethers; however, the binding of the crown ethers was found to increase in the order given above with dicyclohexano-18-crown-6 binding the most tightly and dibenzo-18-crown-6 binding the least tightly.

More particularly, the experiments showing binding of crowns to cytochrome c were done by adding 1, 2, and 3 mol ratios to a 70 pmol/uL mixture of the three different cytochrome c's. The solutions were prepared with equal parts of methanol/water with 1% acetic acid. Typical sample conditions were, 95° C., 2 uL/min, 4000 VDC on the syringe, 170 VDC on the capillary tube, and 60 VDC on the skimmer.

Figure 8:
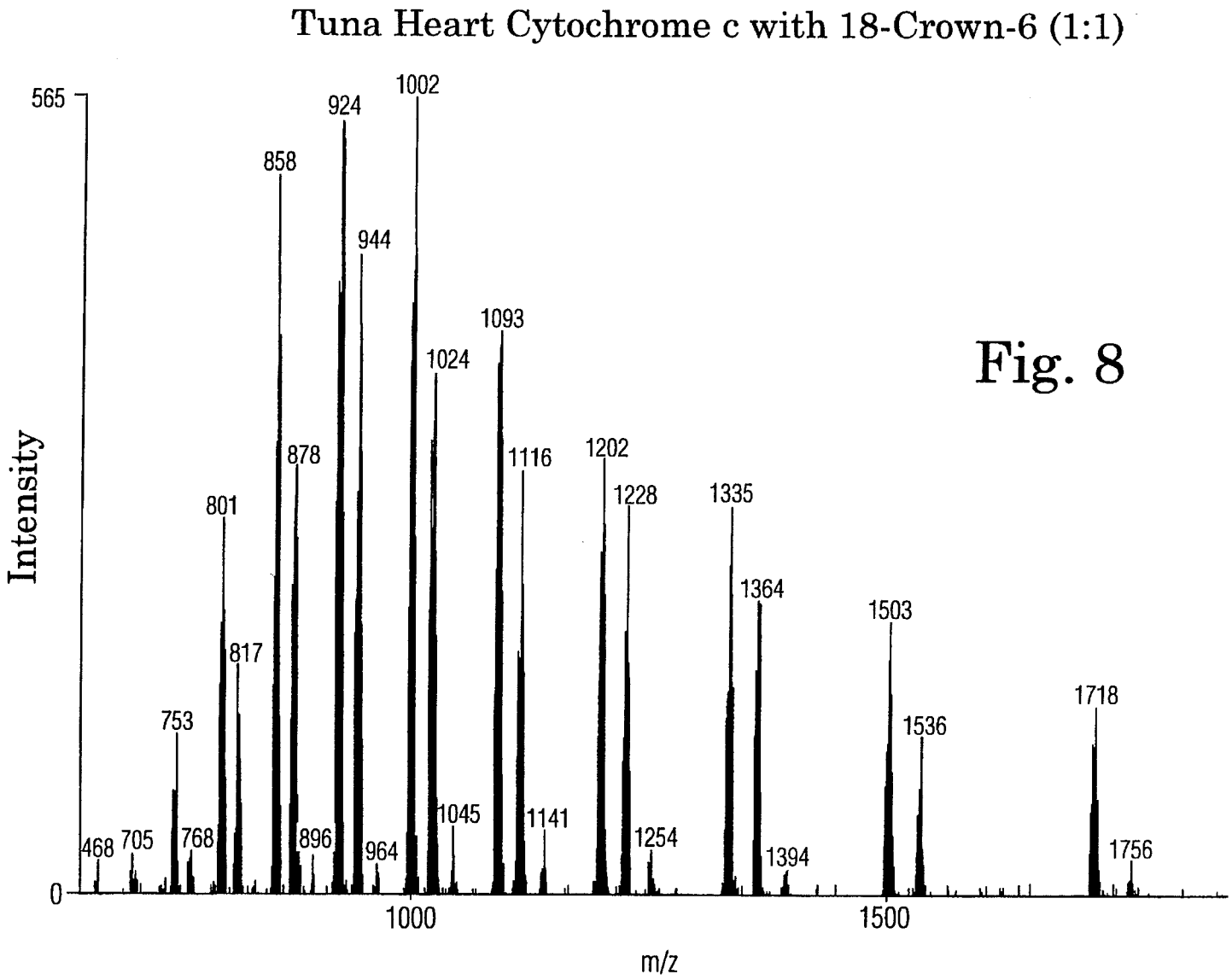
FIG. 8 is an electrospray ionization mass spectrum of cytochrome c (horse heart) with 18-Crown-6 in a 1:1 mol ratio.
Figure 9:
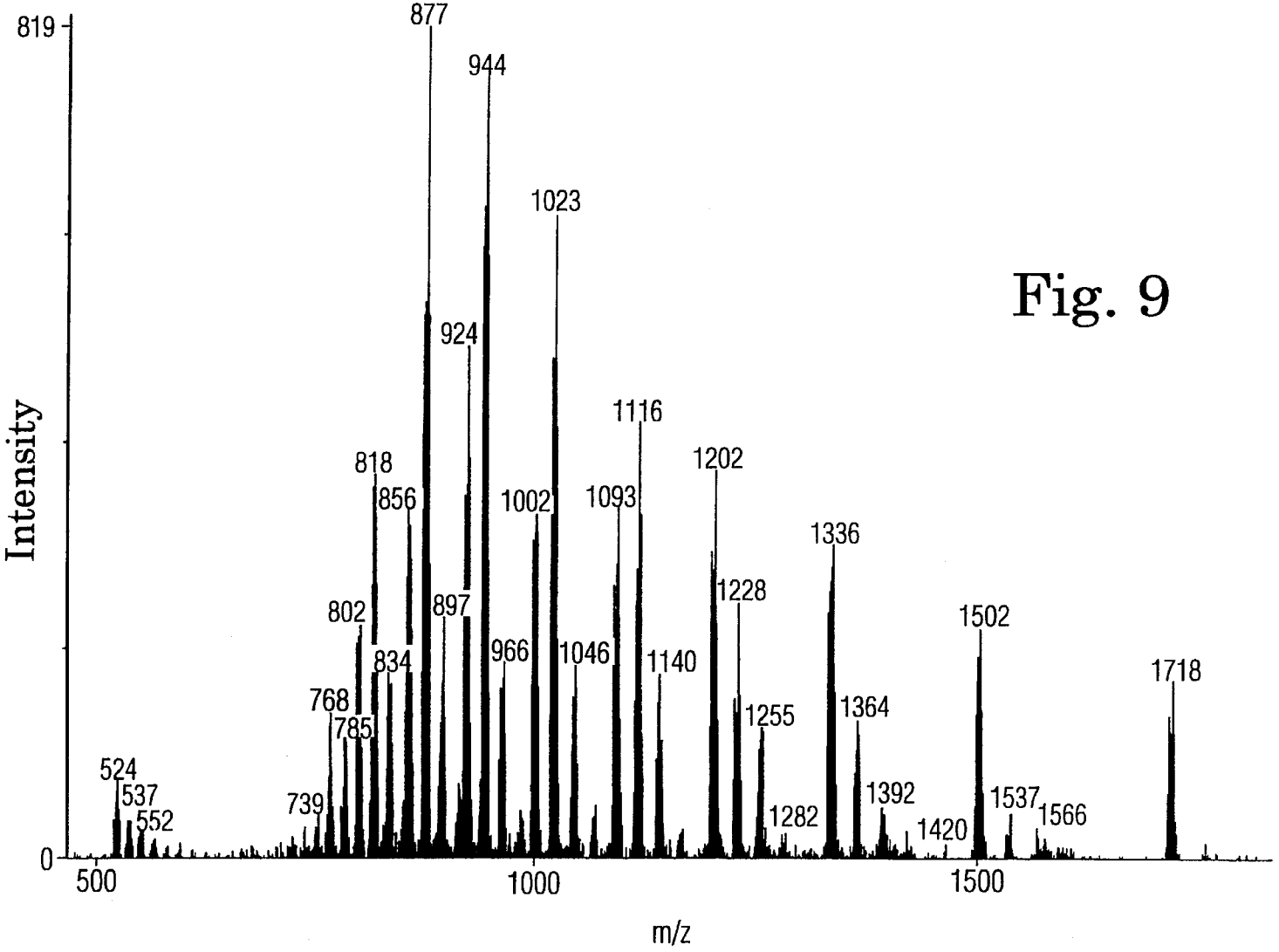
FIGS. 9–11 are electrospray ionization mass spectra of cytochrome c binded with three different crown ethers.
Figure 10:
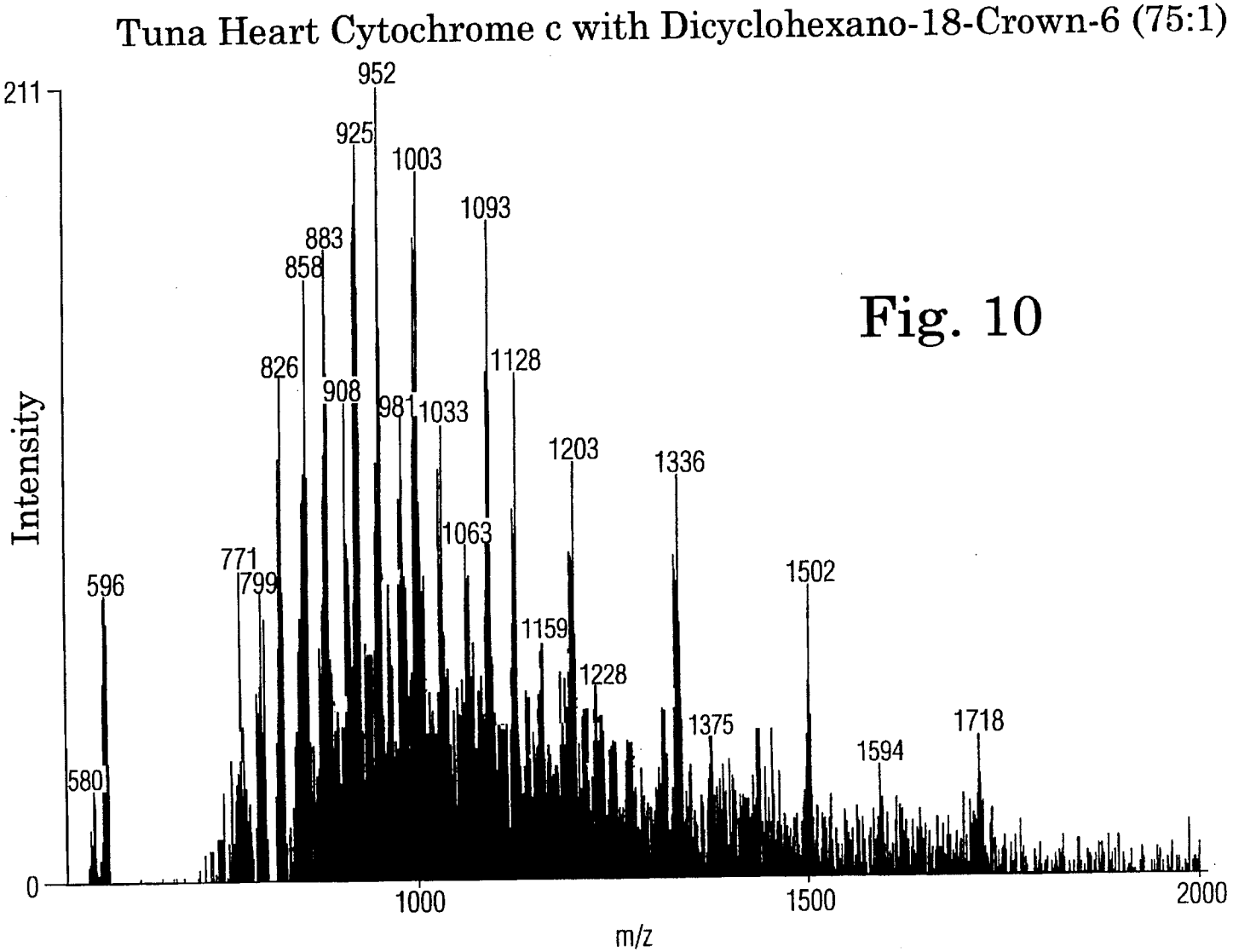
Figure 11:
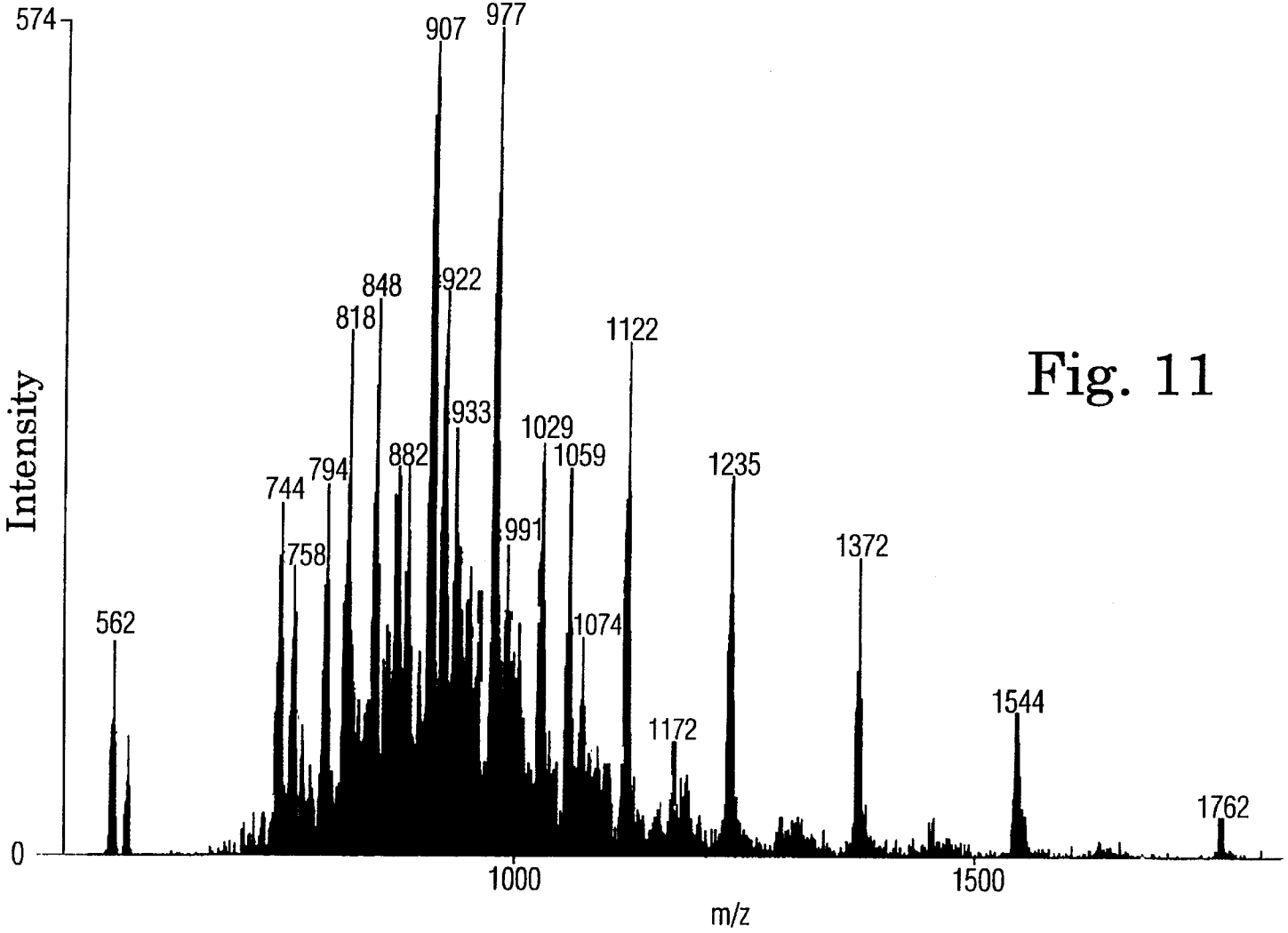
Figure 12:
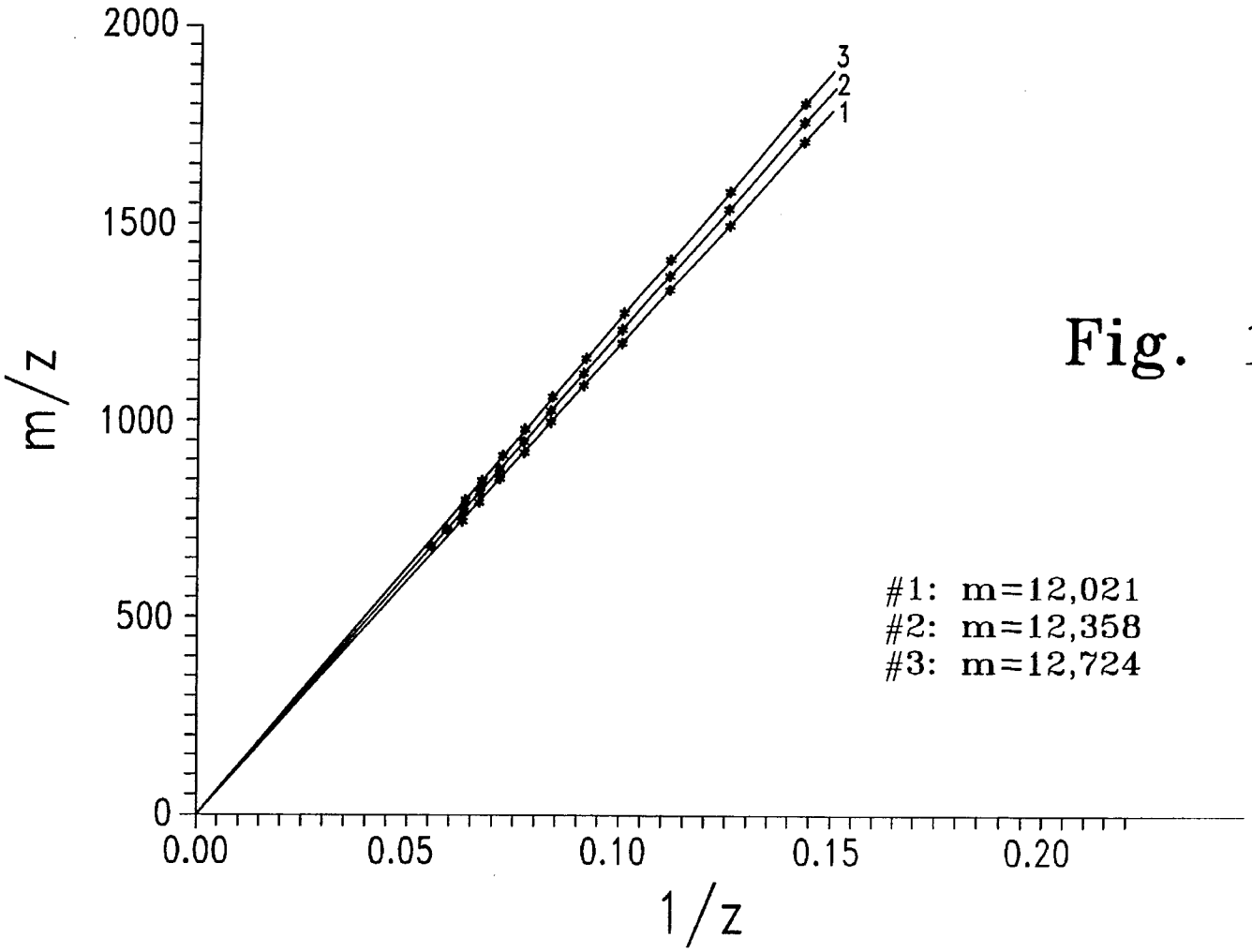
FIGS. 12 and 13 are graphical presentations of the molecular weights of different cytochrome c complexes determined from linear plots of each of the proteins set of characteristic m/z peaks vs. l/z.
Figure 13:
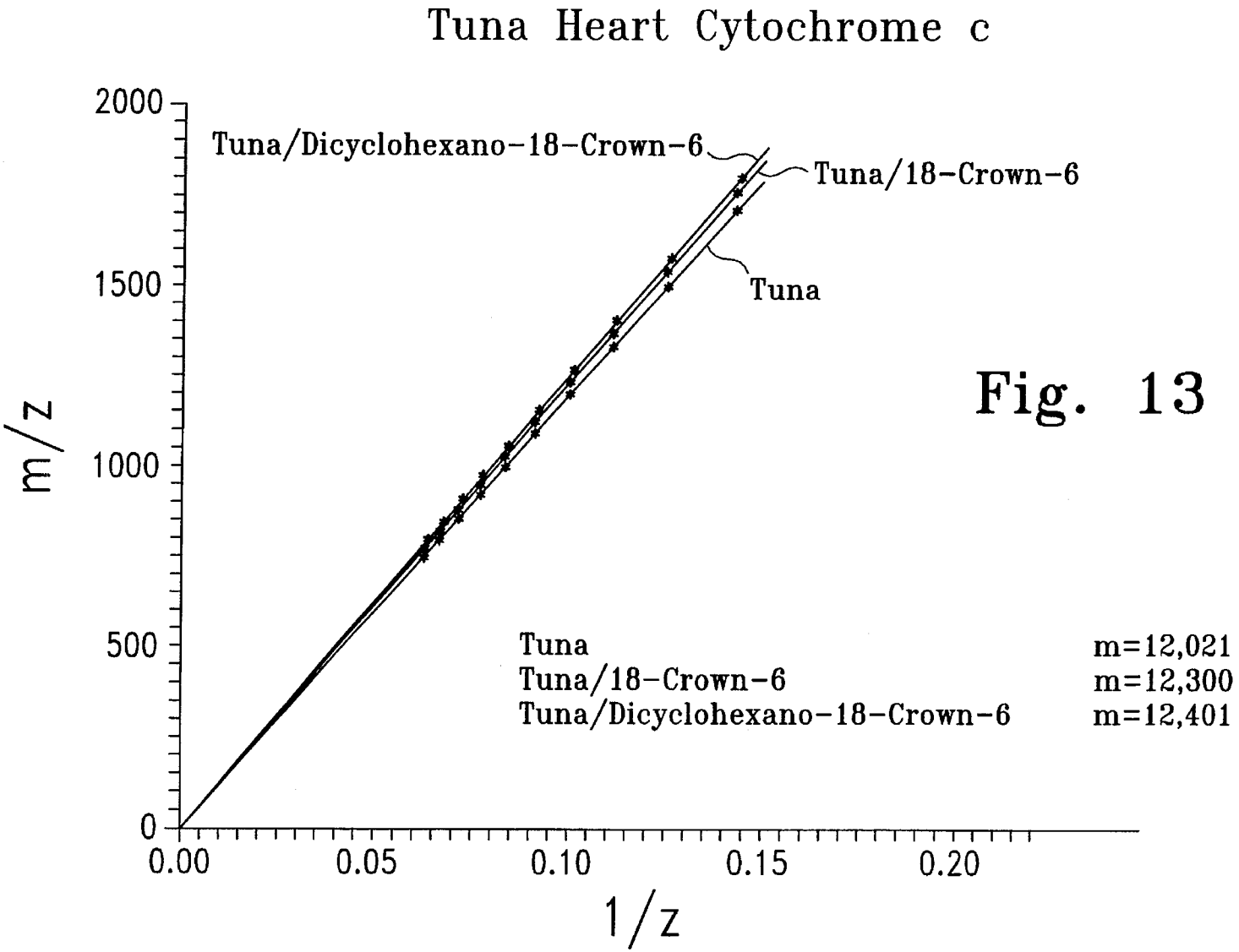
Figure 14A:
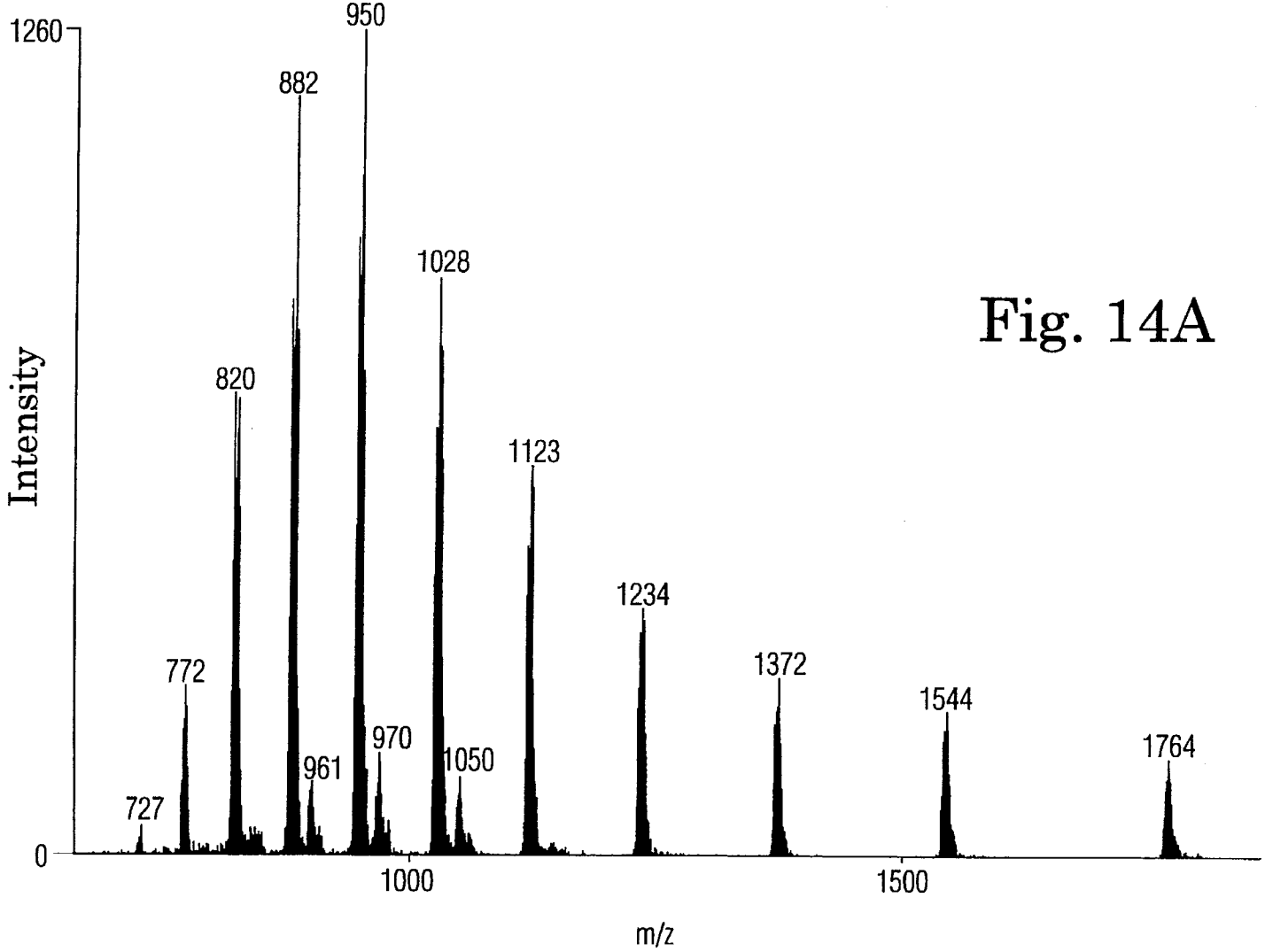
Figure 14B:
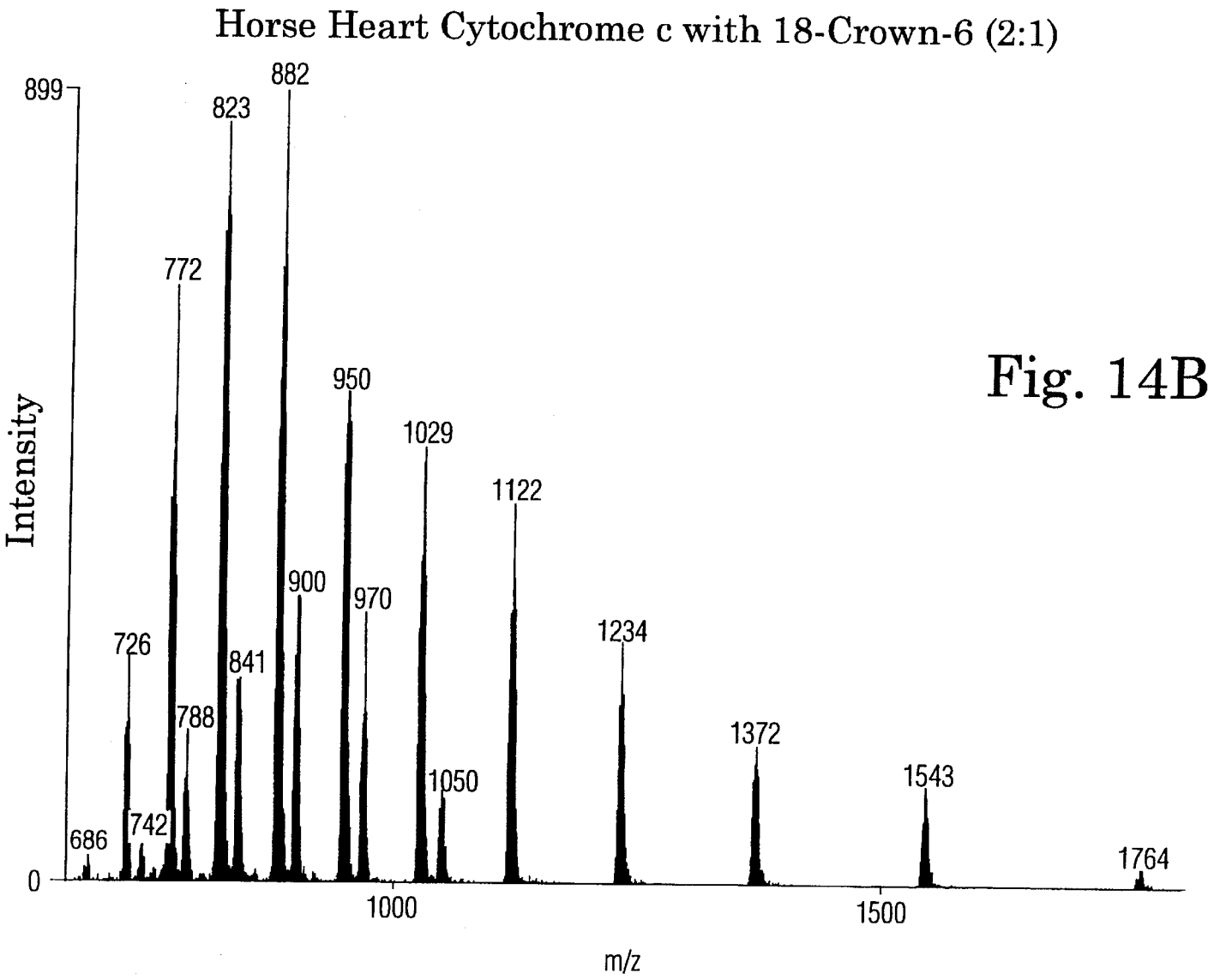
Figure 15:
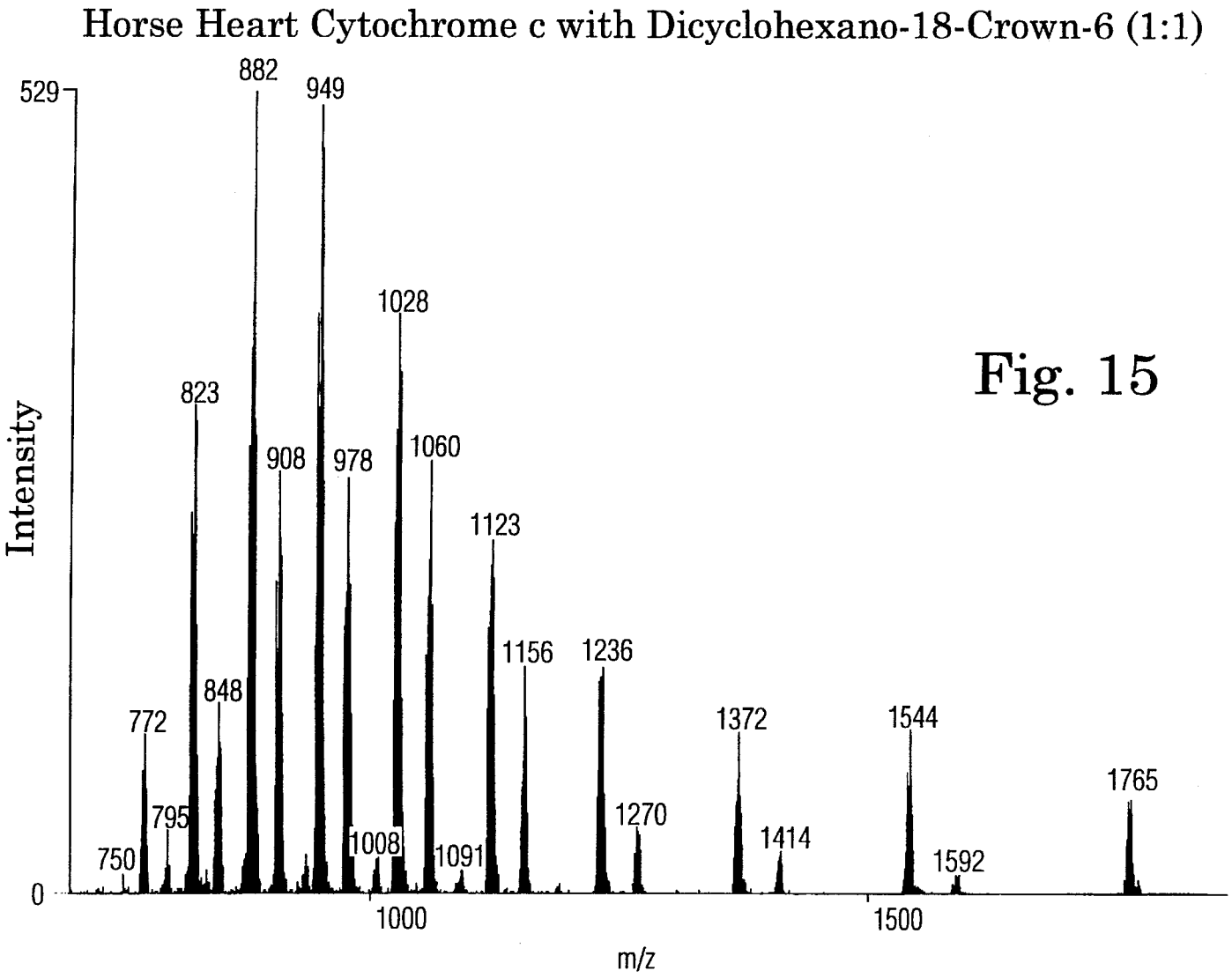
Figure 16:
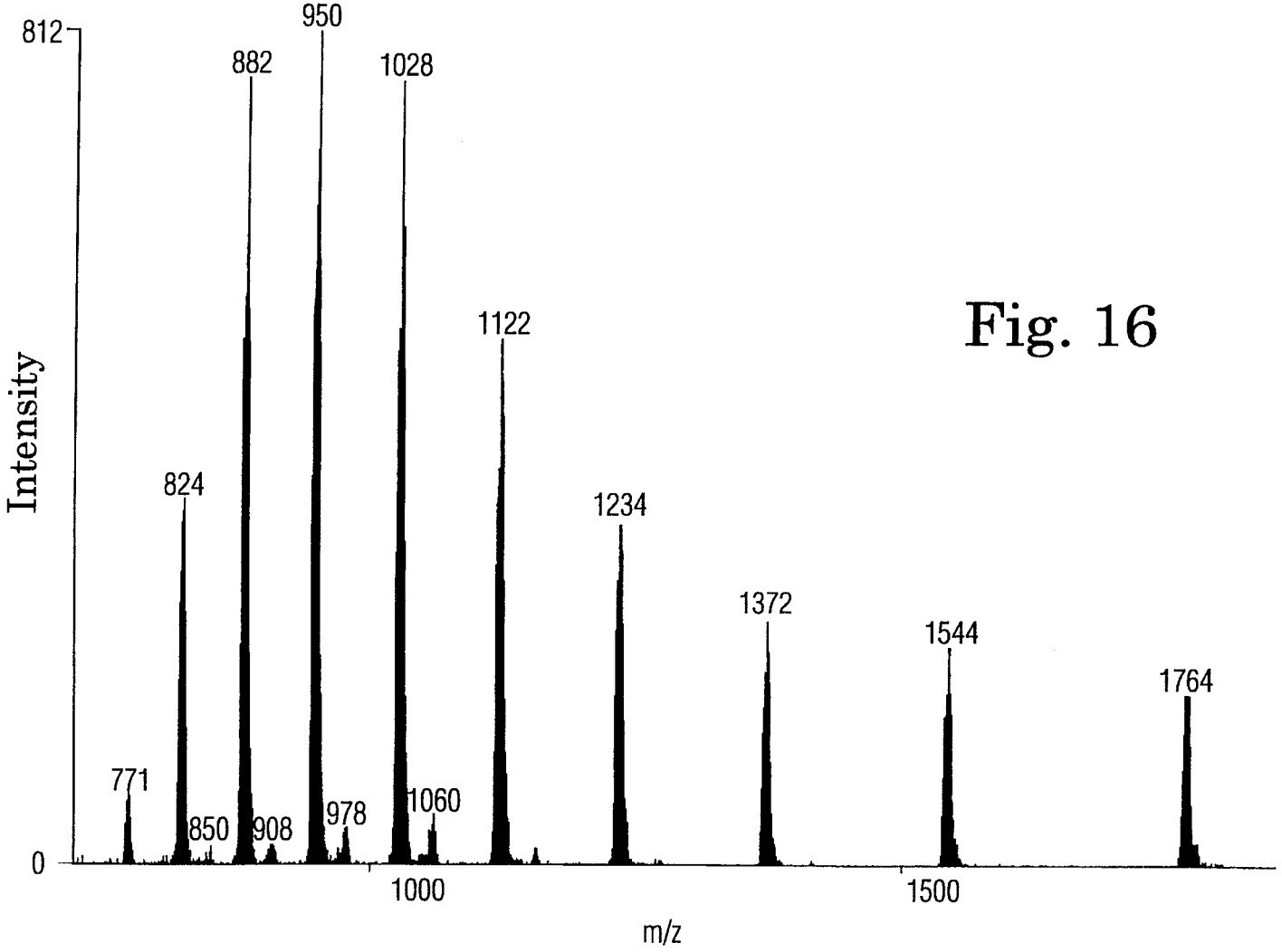

The binding of crowns (shown for Tuna Heart in FIG. 8 and for Horse Heart in FIGS. 14–16) increases with increasing concentration. FIGS. 14A and 14B expressly show the increase in crown binding to Horse Heart that occurred when the concentration was increased from a 1:1 mol ratio to 1:2. An excess of crown produces a spectra showing a pronounced set of peaks corresponding to a protein/protein-crown complex, which in addition exhibits a new species with a greater number of charges (shown for Tuna Heart in FIGS. 9 and 10 and for Horse Heart in FIG. 11). This bimodal distribution may be representative of a conformational change in the protein. The molecular weights of the cytochromes were determined from linear plots of each of the proteins set of characteristic m/z peaks vs. 1/z (FIG. 12), where the slope of the line gives the experimental molecular weight. These values were in close agreement to previously published molecular weights. Similar plots were made to determine the molecular weight of the protein/crown complexes (FIG. 13 shows a plot of two different bound crowns compared to the protein alone).

Signals representing the complex resulting from non-covalent binding of crown ethers to cytochrome c are observed in the ESI mass spectra. Because the crown ethers do not change the proteins charge, the characteristic charge envelope remains. The increase in mass of the complex is seen as an intercalated envelope of a slightly higher m/z. The linear plots of m/z vs. 1/z (FIGS. 12 and 13) passing through the origin have proven to be a simple method for finding the molecular weight of the proteins and protein complexes, as well as providing a test for correct charge assignment. The suggested conformational change of the protein with increasing crown concentration is an interesting result and may be due to an increase of the surface hydrophobicity as suggested by recent work using other approaches.

In this example, the K values for binding were determined from the mass spectra ion counts using the following equation:

$$K = \frac{P_2}{(P_1)\,(P_1/(P_1+P_2))\,(\underline{M})}$$

Where:

$P_1$=the free cytochrome c ion count in the cytochrome c/crown mass spectra.

$P_2$=the cytochrome c/crown complex ion count in the same mass spectra.

M=the molarity of the crown added; $7.0\times10^{-5}$M

The average calculated K values for each of the three crowns bound to the tuna cytochrome c are:

#1. $2.84\times10^4$ $M^{-1}$

#2. $1.22\times10^4$ $M^{-1}$

#3. $2.54\times10^3$ $M^{-1}$

Prior work conducted by others has suggested that the protonated lysine residue is the binding site for the crowns.

Figure 18A:
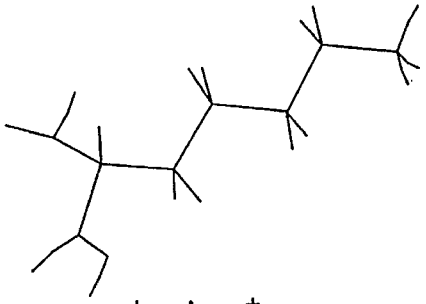
FIGS. 18A–18C present the molecular structure of three protonated amino acid residues of interest, lysine, arginine and histidine.
Figure 18B:
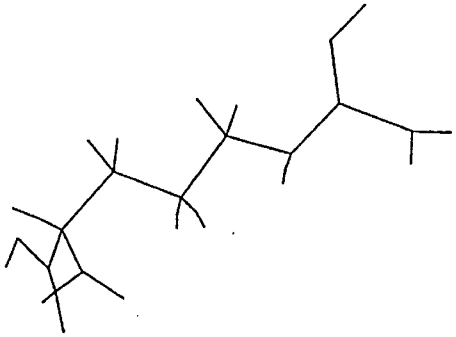
Figure 18C:
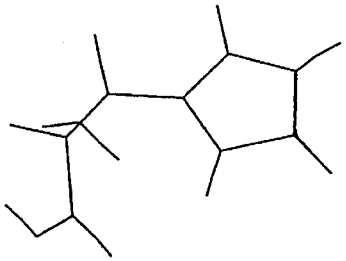
Figure 19:
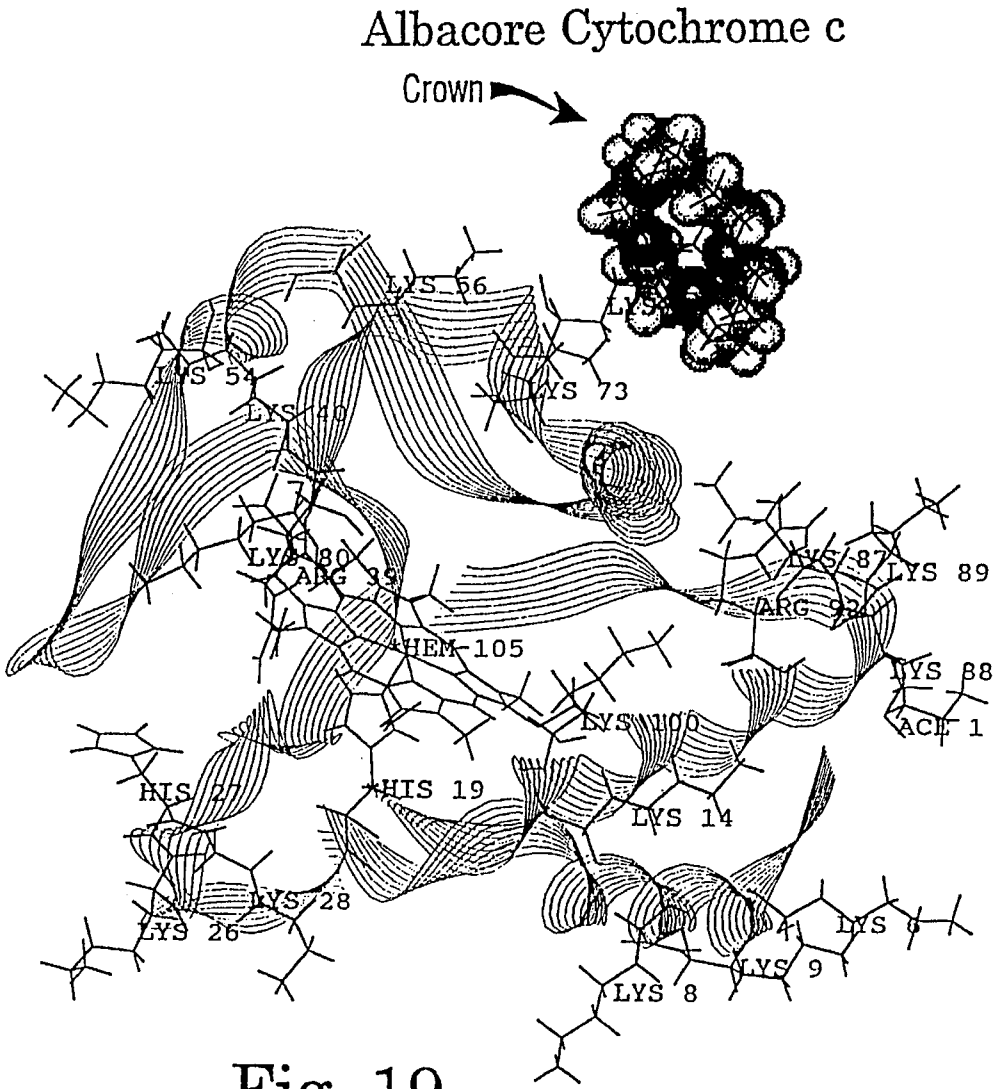
FIG. 19 shows the Brookhaven crystal structure of tuna (Albacore) cytochrome c with only the basic amino acids.
Figure 20A:
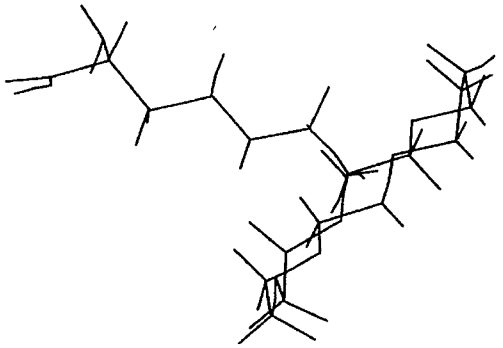
FIGS. 20A–20F present the optimized molecular structures modeling the complexes of protonated amino acids with 18-crown-6 and dibenzo-18-crown 6.
Figure 20B:
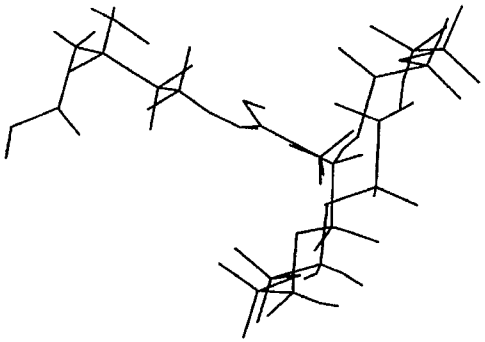
Figure 20C:
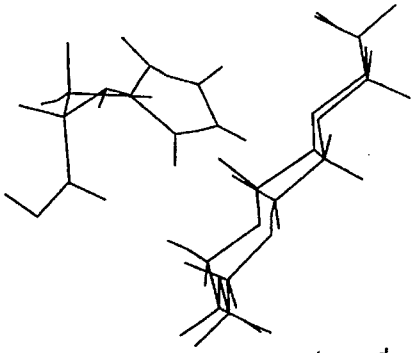
Figure 20D:
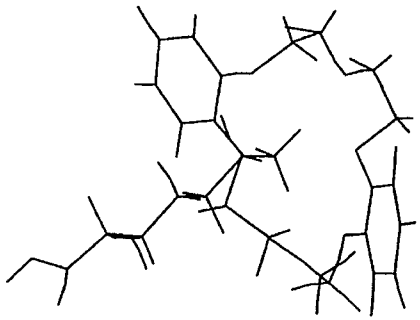
Figure 20E:
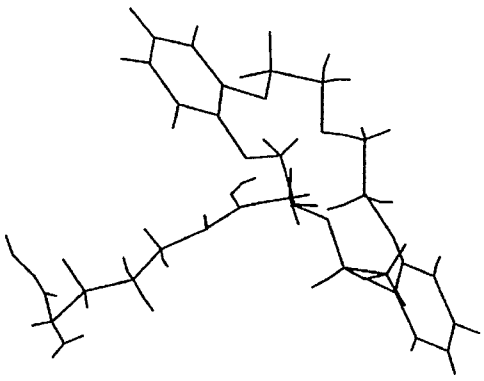
Figure 20F:
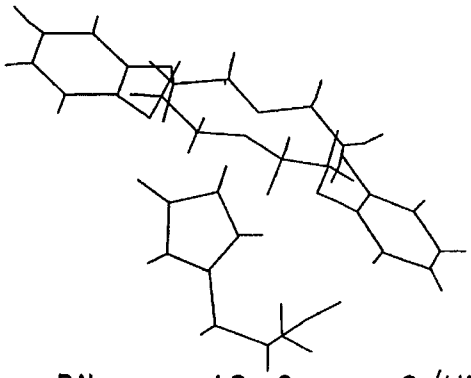

Our computational work has been carried out to better understand the competition that lysine provides for $H_3O^+$, $NH_4^+$ and the other protonated amino acid residues, arginine and histidine (FIGS. 18A–18C). The binding of crowns to the molecules in the solvent system was thus also evaluated. Cytochrome c is a small protein of about 12,500 Daltons, the molecular weight of which varies slightly with the animal or plant species. The surface of cytochrome c has a number of basic amino acids which are protonated at pH 7 when the sample is prepared for ESI/MS. FIG. 19 shows the Brookhaven crystal structure of Tuna (Albacore) cytochrome c with only the basic amino acids, the heme group and ribbon backbone being shown for reference. In FIG. 19, it can be seen where the crown ethers tend to bind to the positively charged residues present on the protein surface. The data in this experiment was acquired using an Extrel ELQ 400 single quadrupole mass spectrometer coupled with the novel electrospray source of the invention. The molecular ions formed from the protein are characterized in the mass spectra by multiple distinct charge states ranging from +20 to +6 depending on the experimental conditions and number of available protonation sites.

It appears from the experimental data that protein/neutral complexes may be structurally revealing and/or ESI enhancing. In either case it is important to apply computational methods to clarify the nature of this binding. The semi-empirical quantum mechanics package, MOPAC (ver. 5.0), with the AM1 Hamiltonian, has been used in conjunction with the molecular modeling package SYBYL (ver. 5.4), running under VAX/VMS (ver. 5.5), in order to determine the heats of formation of the hydrogen bonded crown/cation complex. The molecules were built, merged, annealed and then minimized using the Sybyl Maximin 2 molecular mechanics forcefield. The resultant molecules and complexes were then geometrically optimized using MOPAC/AM1 and the Heats of Formation (see FIGS. 20A–20F) used with Hess's Law to determine relative stability of the complexes.

A comparison of experimental values versus calculated values for $\Delta H_f$ is given in Table 1.

TABLE 1

| Molecule | Thermodynamic Values for Small Molecules/Ions (kcal/mol) $\Delta H_f$ (calc.) [exp.] | $\Delta H_f$ (conj. acid) | PA (calc.)* | PA (lit.) [2] |
|---|---|---|---|---|
| $H_2O$ | −59.2 [−57.8] | 143.5 | 164.5 | 170.3 |
| $HOCH_3$ | −57.0 [−48.1] | 138.3 | 171.9 | 182.2 |
| $NH_3$ | −7.3 [−11.0] | 150.6 | 209.3 | 202.3 |

*$\Delta H_f$ ($H^+$) = 367.1 (JANAF Tables)

The application of Hess's Law to the stability of crown binding to the systems of interest was carried out and a representative sample of the results is shown in Table 2.

TABLE 2

I.
18-Crown-6/$H_3O^+$ + $NH_3$ ——> 18-Crown-6/$NH_4$+ + $H_2O$
−203.36 −7.28 −184.87 −59.24
Heat of Formation = −33.47 kcal/mol II.
18-Crown-6/$CH_3OH_2$+ + $H_2O$ ——> 18-Crown-6/$H_3O^+$ + $CH_3OH$
−191.31 −59.24 −203.36 −57.03
Heat of Formation = −9.84 kcal/mol III.
18-Crown-6/$CH_3OH_2$+ + Lys ——> 18-Crown-6/$Lys^+$ + $CH_3OH$
−191.31 −116.31 −294.96 −57.03
Heat of Formation = −44.37

IV.
18-Crown-6/$H_3O^+$ + Lys ——> 18-Crown-6/$Lys^+$ + $H_2O$
−203.36 −116.31 −294.96 −59.24
Heat of Formation = −34.53 kcal/mol V.
18-Crown-6/$H_3O^+$ + Arg ——> 18-Crown-6/$Arg^+$ + $H_2O$
−203.36 −75.13 −249.25 −59.24
Heat of Formation = −30.00 kcal/mol VI.
Dibenzo-18-Crown-6/$H_3O^+$ + Lys –> Dibenzo-18-Crown-6/$Lys^+$ + $H_2O$
−106.62 −116.31 −194.52 −59.24
Heat of Formation = −30.83

VII.
Dicyclohexyl-18-Crown-6/$H_3O^+$ + Lys –> Dicyclohexyl-18-Crown-6/$Lys^+$ + $H_2O$
−233.14 −116.31 −325.12 −59.24
Heat of Formation = −34.91

Figure 21:
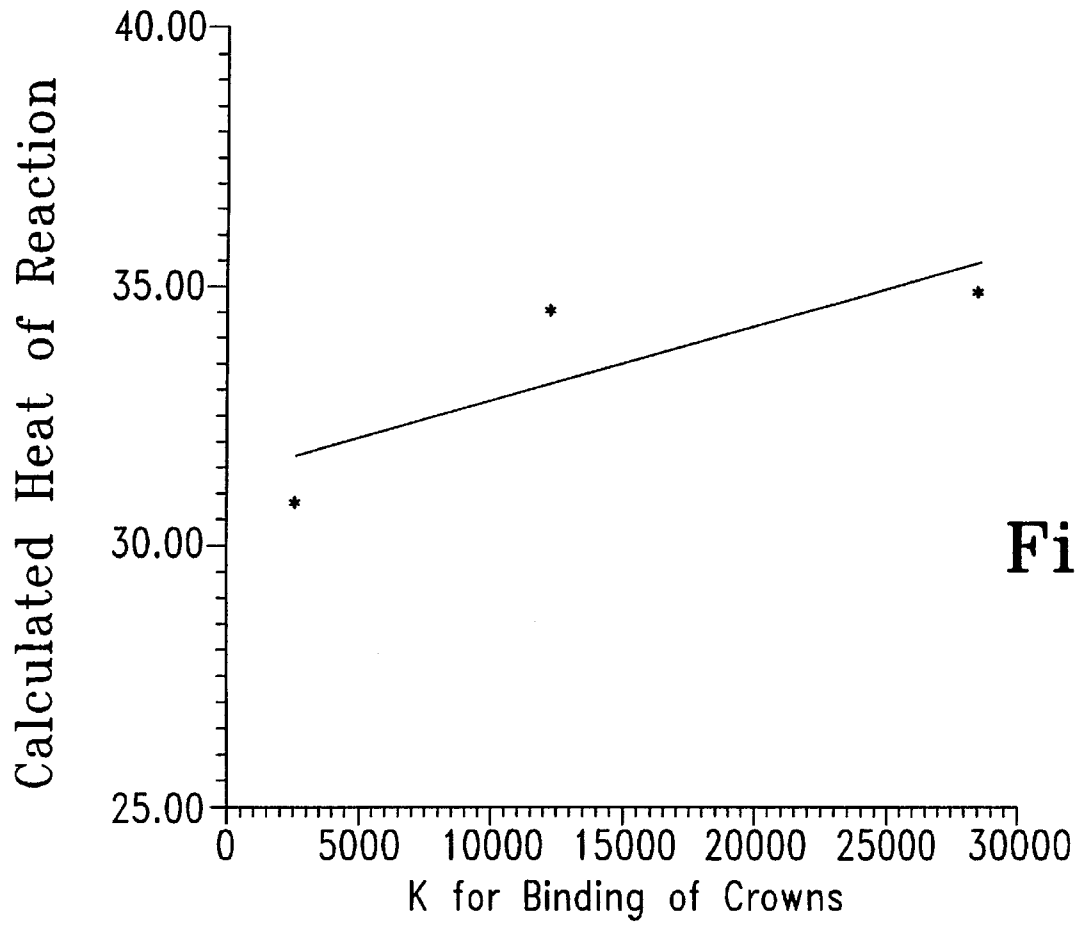
FIG. 21 is a graphical presentation of the linear plot of the trend for the calculated $\Delta H_f$ following that of the experimentally determined K for the binding of crown ethers to cytochrome c.

The calculated heats of formation indicate that little complex formation occurs with the molecules from the ESI/MS solvent system, a water/acetic acid and methanol mixture. (The solvent system molecules of interest being hydronium ion and protonated methanol.) From Table 2 (eq. II.), the complex of 18-crown- 6 with hydronium ion is favored over protonated methanol by −9.8 kcal/mol. The 18-crown-6/lysine$^+$ complex is favored over both protonated methanol and hydronium ion (eq. III and IV) as are the other two amino acids, arginine and histidine (eq. V). The complex of 18-crown-6/lysine$^+$ is also favored over the complex with ammonium ion by −1.06 kcal/mol; however, formation of complexes of 18-crown-6 with arginine (+3.47 kcal/mol) and histidine (+70.13 kcal/mol) both are less exothermic than the reaction of crown with the ammonium ion. Optimized structures modeling the complexes of protonated amino acids with 18-crown-6 and dibenzo-18-crown-6 are shown in FIG. 20. The $\Delta H_f$ for the crowns show that the most stable complex formed combines lysine with dicyclohexyl-18-crown-6 (−34.91 kcal/mol, eq. VII), 18-crown-6 (−34.53 kcal/mol, eq. IV), dibenzo-18-crown-6 (−30.83 kcal/mol, eq. VI). The trend for the calculated $\Delta H_f$ follows that of the experimentally determined K for the binding of crown ethers to cytochrome c, the linear plot for which is shown in FIG. 21. The calculations presented in Table 2, considered in combination with the data presented in FIGS. 8 and 19, confirm for the very first time that crown ethers do in fact attach to positive residues present on the protein surface. This phenomenon had only been speculated before applicants' discovery.

Interface cleaning of the system 10 can be accomplished with the probe 50 removed by using three strategies. The capillary tube 54 and skimmer opening 71 may be reamed with 360 micron O.D. fused silica capillary tubing. Alternately, the fused silica capillary tubing may be connected to high-performance liquid chromatography pumps which then flush the stainless-steel capillary tube 54 and skimmer cone 70 with an appropriate solvent ($MeOH/H_2O$, dichloromethane). Finally, the inside of the probe 50 may be washed by filling the probe with a solvent at the roughing pump connection (tee 53) and rinsing.

The ESI probe utilizes a heated capillary for desolvation and features a sampling or skimmer cone and a threaded capillary tube resting in a threaded spacer. This design allows easy and reproducible adjustment between the tube and skimmer. All ESI probe components are concentric with the lens and quadrupole analyzer. The positioning of the probe may follow either of two patterns: just in front of the repeller contacts for the removable ion volume with the standard 400 series EI/CI lens assembly or approximately 0.5–3.0 cm from the first lens in the lens stack 12*a*.

The ability to switch between EI/CI and ESI by simply removing the ion volume and inserting the ESI probe (10–15 minutes) without physically reconfiguring the instrument adds greatly to the versatility of this invention. The 13-mm probe diameter facilitates the use of ESI experiments on any instrument with a 13-mm (or one-half inch) vacuum lock coaxial to the lens assembly. The ESI probe can also be used with a modified fast-atom bombardment (FAB) lens stack consisting of three lenses. The size of the probe, the convenience of its use, the ready availability of its components, the ease of adjustment of its dimensions, its demonstrated high ion currents with or without modification of the remaining structure of the source, and the ease with which it can be maintained and modified, each contribute to the enhanced utility of the invention.

This invention thus provides an economical ESI source designed as a probe capable of insertion into a standard 13-mm (one-half inch) vacuum lock that has been shown to produce the same spectra as those produced with other much more expensive and complex electrospray sources. The probe construction of assembled components in a glass tube reduces the volume so that a 13-mm vacuum lock of conventional mass spectrometers may be accommodated. The decreased radius requires increased pumping capacity on the probe. The demonstrated ability to use this ESI probe with a standard configuration EI/CI lens assembly has obvious advantages.

Applicants have concluded from their studies that the crown ether molecules bind to the positively charged amino acid residues on the surface of the protein molecules, thereby changing the three-dimensional structure and increasing the hydrophobicity of the protein surface making the protein surface more non-polar. With this invention, it is now possible to bind small molecules to charged residues on the protein surface which would allow a desirable modification of protein function. More particularly, this invention provides the ability to locate positively charged residues on the surface of a protein by identifying or locating groups that may become attached to the crown ether(s). Furthermore, these newly attached functions can alter the function and character of the protein. This aspect of the invention is significant in pharmaceutical research and development because drugs perform primarily by modifying the manner in which proteins perform physiologically. Accordingly, it is important in such research to be able to focus on what binds to proteins to determine how to modify their behavior.

While the system, source and method described above constitutes a presently preferred embodiment of the invention, the invention can take many forms. Accordingly, it should be understood that the invention is to be limited only insofar as is required by the scope of the following claims.

We claim:

1. An electrospray ionization probe assembly for introducing a sample of ions into a mass spectrometer for mass spectrometric analysis, said sample being generated by electrospray means generating a spray of charged droplets containing molecules of interest and solvent, said probe assembly comprising:

a desolvation tube having an entrance orifice and an exit orifice;

means for applying a first voltage to said desolvation tube;

means for heating said desolvation tube;

thermocouple means for measuring the temperature adjacent the exit orifice of said desolvation tube;

skimmer means for focusing and directing said ions to the mass spectrometer, said skimmer means having a second voltage applied thereto and an orifice electrically isolated from the desolvation tube, said skimmer means orifice being positioned at a distance from the exit orifice of said desolvation tube;

adjustable lens means positioned in front of said skimmer means for initially focusing ions after the ions exit the desolvation tube and prior to entering said skimmer means orifice, said adjustable lens means being electrically conductive and having the same or different electrical charge as said desolvation tube, said adjustable lens means being adjustable such that a distance between said skimmer means orifice and said adjustable lens means is variable; and an evacuable dielectric housing for said desolvation tube, heating means, thermocouple means, skimmer means, and lens means.

2. An electrospray ionization probe assembly for introducing a sample of ions into a mass spectrometer for mass spectrometric analysis, said sample being generated by an electrospray source generating a spray of charged droplets containing molecules of interest and solvent, said probe assembly comprising:

a desolvation tube having an entrance orifice and an exit orifice;

means for applying a first voltage to said desolvation tube;

means for heating said desolvation tube;

a thermocouple for measuring the temperature adjacent the exit orifice of said desolvation tube;

a skimmer for focusing and directing said ions to the mass spectrometer, said skimmer having a second voltage applied thereto and an orifice electrically isolated from the desolvation tube, said skimmer orifice being positioned at a fixed distance from the exit orifice of said desolvation tube;

an electrically conductive lens positioned in front of said skimmer for initially focusing said ions after their exiting from the desolvation tube and prior to their entering the skimmer orifice, said lens having an adjustable engagement with said desolvation tube such that the distance between the lens and the skimmer orifice is variable; and an evacuable dielectric housing for housing said desolvation tube, heating means, thermocouple, skimmer, and lens.

3. The electrospray ionization probe assembly of claim 2 wherein said first voltage applying means is adapted to apply said first voltage to said desolvation tube at a point externally of said dielectric housing.

4. The electrospray ionization probe assembly of claim 2 further comprising a vacuum fitting in the evacuable dielectric housing disposed adjacent the entrance orifice of said desolvation tube.

5. The electrospray ionization probe assembly of claim 4 wherein said desolvation tube is a capillary tube and said evacuable dielectric housing is defined by a tubular encasement.

6. The electrospray ionization probe assembly of claim 5 wherein said capillary tube is adjustable relative to said skimmer for selectively adjusting said distance therebetween.

7. The electrospray ionization probe assembly of claim 2 wherein said lens comprises a threaded metal spacer adapted to be threadably affixed to the desolvation tube adjacent the exit orifice thereof.

8. The electrospray ionization probe assembly of claim 2 wherein said lens includes voids provided about its circumference.

9. The electrospray ionization probe assembly of claim 2 wherein said desolvation tube has a length no greater than about 500 millimeters.

10. The electrospray ionization probe assembly of claim 2 wherein said desolvation tube has an inner diameter of about 0.020 inch (0.51 mm.) and an outer diameter of about 0.0625 inch (1.59 mm.).

11. The electrospray ionization probe assembly of claim 5 wherein said encasement has an inner diameter of about 0.39 inch and an outer diameter of about 0.51 inch.

12. The electrospray ionization probe assembly of claim 2 wherein said heating means comprises an electrical resistance wire wound about said desolvation tube.

13. The electrospray ionization probe assembly of claim 2 wherein said desolvation tube is metal and is heated by resistive heating.

14. The electrospray ionization probe assembly of claim 2 wherein said heating means heats the desolvation tube in the temperature range of about 25° C. to about 200° C.

15. The electrospray ionization probe assembly of claim 2 wherein said lens is not electrically insulated from said desolvation tube.

16. The electrospray ionization probe assembly of claim 2 wherein said lens is electrically isolated from said desolvation tube, and wherein said assembly further includes means for applying a voltage to said lens means.

17. The electrospray ionization probe assembly of claim 2 wherein said thermocouple comprises a temperature sensor operably connected to a readout means.

18. The electrospray ionization probe assembly of claim 2 wherein said first voltage applying means applies a voltage to the desolvation tube of about 2–1000 V.

19. The electrospray ionization probe assembly of claim 2 wherein the evacuable dielectric housing of said assembly is dimensioned so as to be sealingly receivable within a one-half inch (13 mm) inlet orifice of a mass spectrometer.

20. The electrospray ionization probe assembly of claim 19 wherein said mass spectrometer includes an inlet orifice and a lens assembly, and the inlet orifice of said mass spectrometer allows for the selective positioning of the skimmer orifice relative to the lens assembly of the mass spectrometer.

21. The electrospray ionization probe assembly of claim 2 wherein said lens supports the desolvation tube concentrically within the evacuable dielectric housing.

22. A system for analyzing the mass spectra of molecules of interest, comprising:

a mass spectrometer having a lens stack and an inlet orifice for receiving therethrough ionized molecules of interest to be analyzed; and an electrospray ion source adapted to be sealingly received within the inlet orifice of said mass spectrometer for introducing ionized molecules of interest therein for analysis, said electrospray ion source including:

a source of a dilute solution of the molecules of interest;

electrospray means for spraying tiny charged droplets of said solution;

means for imposing a first voltage on said electrospray means;

a desolvation tube having an entrance orifice positioned across a gap from said electrospray means for receiving said charged droplets and an exit orifice for ionized molecules of interest;

means for imposing a second voltage on said desolvation tube;

means for heating said desolvation tube;

thermocouple means for monitoring the temperature of said desolvation tube;

a sampling cone having a variable voltage applied thereto for directing said ionized molecules of interest to the mass spectrometer, said sampling cone having an outlet orifice and an inlet orifice, said inlet orifice being electrically isolated and positioned at a first distance from the exit orifice of said desolvation tube;

a lens positioned for initially focusing said ionized molecules of interest after exiting the desolvation tube and prior to entering said sampling cone, said lens being adjustably affixed to the desolvation tube adjacent the exit orifice thereof such that the distance between said lens and the inlet orifice of said sampling cone is variable;

an evacuable tubular encasing for housing said desolvation tube, heating means, thermocouple means, sampling cone, and lens, said mass spectrometer having a vacuum chamber in communication with the inlet orifice of said mass spectrometer, said inlet orifice of said mass spectrometer forming a vacuum seal with said evacuable encasing adjacent the outlet orifice of the sampling cone; and means for creating a vacuum in said mass spectrometer, inlet orifice and evacuable encasing.

23. The mass spectrometric analysis system of claim 22 wherein said source of a dilute solution of molecules of interest includes a syringe needle tube through which the solution is pumped to said electrospray means.

24. The mass spectrometric analysis system of claim 22 wherein the exit orifice of said desolvation tube is positioned about 1 to 10 millimeters from the inlet orifice of said sampling cone, said sampling cone being positioned about 0.5 to 5 centimeters in front of the lens stack of the mass spectrometer.

25. The mass spectrometric analysis system of claim 22 wherein said gap between the electrospray means and the desolvation tube is about 0.5–5.0 centimeters (0.20–1.99 inches).

26. The mass spectrometric analysis system of claim 22 wherein said heating means comprises an electrical resistance wire wound about said desolvation tube.

27. The mass spectrometric analysis system of claim 22 wherein said electrospray ion source further comprises a vacuum fitting disposed adjacent the entrance orifice of said desolvation tube.

28. The mass spectrometric analysis system of claim 22 wherein the lens is not electrically isolated from said desolvation tube.

29. The mass spectrometric analysis system of claim 22 wherein said lens comprises a threaded cylindrical element adapted to be threadably affixed to the desolvation tube adjacent the exit orifice thereof.

30. The mass spectrometric analysis system of claim 22 wherein said lens comprises a cylindrical spacer for said desolvation tube having a threaded axial bore extending therethrough for transporting and focusing said ions therethrough.

31. The mass spectrometric analysis system of claim 30 wherein said lens includes a plurality of longitudinal voids provided about its circumference.

32. The mass spectrometric analysis system of claim 22 wherein said thermocouple means comprises a temperature sensor operably connected to a readout means.

33. The mass spectrometric analysis system of claim 22 wherein said mass spectrometer is a single quadrupole mass spectrometer.

34. The mass spectrometric analysis system of claim 22 wherein said desolvation tube is adjustable relative to said sampling cone for selectively adjusting the distance therebetween.

35. The mass spectrometric analysis system of claim 22 wherein said desolvation tube is an electrically conductive tube.

36. The mass spectrometric analysis system of claim 22 wherein said desolvation tube has a length no greater than approximately 500 millimeters.

37. The mass spectrometric analysis system of claim 22 wherein said encasing has an internal diameter of about 0.39 inch and an external diameter of about 0.51 inch.

38. The mass spectrometric analysis system of claim 22 wherein said desolvation tube has an internal diameter of about 0.020 inch (0.51 mm.) and an external diameter of about 0.0625 inch (1.59 mm.).

39. A method for introducing desolvated or partially desolvated ionized molecules of interest into a mass spectrometer for analysis, said method comprising:

creating a dilute solution of molecules of interest in a solvent;

charging said solvent and molecules of interest;

generating a fine spray of tiny droplets of said dilute solution of molecules of interest and solvent;

providing a desolvation tube having an entrance orifice and an exit orifice;

providing a sampling cone downstream of the exit orifice of said desolvation tube;

positioning the entrance orifice of said desolvation tube adjacent the point of generation of the fine spray of tiny droplets;

applying a first voltage to said desolvation tube;

applying a second voltage to said sampling cone, said second voltage being equal to or lesser than the first voltage applied to said desolvation tube;

receiving said charged droplets of said dilute solution in the entrance orifice of said desolvation tube;

transporting said droplets to the exit orifice of said desolvation tube;

controllably heating said desolvation tube to partially or substantially desolvate said droplets during their transport therethrough to provide ionized molecules of interest at the exit orifice of said desolvation tube;

focusing said ionized molecules of interest utilizing a lens positioned upstream from said sampling cone, said lens having a central orifice extending therethrough disposed in axial alignment with the exit orifice of said desolvation tube, said lens comprising an electrically conductive element having an adjustable engagement with said desolvation tube such that a distance between said lens and said sampling cone is variable; and directing the focused ionized molecules of interest upon their exit from the lens through said sampling cone, said sampling cone having an orifice extending therethrough disposed in axial alignment with the exit orifice of the desolvation tube and the central orifice of said lens, whereby the voltage differential between said desolvation tube and said sampling cone electrostatically focuses and selects ions of proper kinetic energy for transport to the mass spectrometer.

40. The ion introduction method of claim 39 wherein said lens comprises a cylindrical metal element having internally threaded means arranged within the central orifice thereof and segments extending radially outwardly defining voids therebetween about the circumference of said lens, said lens being adapted to be threadably affixed to said desolvation tube adjacent the exit orifice thereof.

41. A method for characterizing the three-dimensional structure of a protein molecule, said method comprising:

(a) performing electrospray ionization mass spectrometry (ES-MS) to obtain the spectrum of a protein-small molecule complex, said ES-MS being performed as follows:

creating a solution of a small molecule, a larger protein molecule, and protein/small molecule complexes;

charging said solution and molecules of interest;

generating a fine spray of tiny droplets of said solution;

providing a desolvation tube having an entrance orifice and an exit orifice;

positioning the entrance orifice of said desolvation tube adjacent the point of generation of the fine spray of tiny droplets;

applying a voltage to said desolvation tube;

receiving said charged droplets in the entrance orifice of said desolvation tube;

transporting said droplets to the exit orifice of said desolvation tube;

controllably heating said desolvation tube to substantially desolvate said droplets during their transport therethrough to provide ionized protein molecules at the exit orifice of said desolvation tube;

focusing said ionized protein molecules after exiting the desolvation tube between said exit orifice and a mass spectrometer utilizing a lens positioned adjacent the exit orifice of said desolvation tube, said lens having a bore extending therethrough in axial alignment with the exit orifice of said desolvation tube;

directing the focused ionized protein molecules upon their exit from the lens through a skimmer to remove inadequately ionized protein molecules, said skimmer having an orifice extending therethrough in axial alignment with said exit orifice of said desolvation tube and the axial bore of said lens; and analyzing the ionized protein molecules in a mass spectrometer to obtain said spectrum;

(b) using said spectrum from step (a) to calculate the binding constant $K_B$ for the binding of the small molecule to the protein;

(c) repeating steps (a) and (b) with additional different small molecules;

(d) calculating the heat of formation $\neq H_f$ for the binding of each of the small molecules used in steps (a)–(c) to a selected residue on the protein;

(e) repeating step (d) for other selected residues on the protein;

(f) comparing the $K_B$ values calculated in steps (b) and (c) with the $\Delta H_f$ values calculated in steps (d) and (e); and (g) utilizing the comparisons of step (f) to characterize the three-dimensional structure of the protein.

42. The protein characterization method of claim 41 wherein the comparisons of step (f) are utilized to identify the residue or residues on the surface of the protein molecule to which the small molecule is bound.

43. The protein characterization method of claim 41 wherein the small molecules are crown ethers.

* * * * *